US009375831B2

(12) United States Patent
Wang

(10) Patent No.: US 9,375,831 B2
(45) **Date of Patent: *Jun. 28, 2016**

(54) HAND TOOL

(71) Applicant: EZCONN CORPORATION, Taipei (TW)

(72) Inventor: Cheng-Hui Wang, Taipei (TW)

(73) Assignee: EZCONN CORPORATION, Taipei (TW)

( * ) Notice: Subject to any disclaimer, the term of this patent is extended or adjusted under 35 U.S.C. 154(b) by 275 days.

This patent is subject to a terminal disclaimer.

(21) Appl. No.: 14/092,963

(22) Filed: Nov. 28, 2013

(65) Prior Publication Data

US 2014/0083261 A1 Mar. 27, 2014

Related U.S. Application Data

(63) Continuation-in-part of application No. 13/137,644, filed on Aug. 31, 2011, now Pat. No. 8,794,111.

(51) Int. Cl.

| | |
|---|---|
| ***B25B 13/48*** | (2006.01) |
| ***B25B 23/142*** | (2006.01) |
| ***B25G 1/06*** | (2006.01) |

(52) U.S. Cl.

CPC ..... *B25B 23/142* (2013.01); *B25B 13/48* (2013.01); *B25B 13/481* (2013.01); *B25B 23/1427* (2013.01); *B25G 1/063* (2013.01)

(58) Field of Classification Search

CPC .. B25B 13/48; B25B 23/142; B25B 23/1427; B25G 1/066

See application file for complete search history.

(56) References Cited

U.S. PATENT DOCUMENTS

| | | | | |
|---|---|---|---|---|
| 1,328,087 | A | 1/1920 | Le Chot | |
| 2,426,763 | A * | 9/1947 | Curtis | B25B 13/481 81/125.1 |
| 2,578,687 | A | 12/1951 | Fish | |
| 2,978,938 | A * | 4/1961 | Nalley | B23B 7/02 81/177.2 |
| 3,010,346 | A | 11/1961 | Kulp | |
| 4,084,456 | A * | 4/1978 | Pasbrig | B25B 13/12 81/125.1 |
| 7,080,581 | B2 | 7/2006 | Reese | |
| 8,794,111 | B2 * | 8/2014 | Wang | B25B 13/48 81/124.2 |
| 2004/0083861 | A1 * | 5/2004 | Hu | B25G 1/063 81/177.8 |
| 2013/0047800 | A1 | 2/2013 | Wang | |
| 2013/0199345 | A1 * | 8/2013 | Nino | A61B 17/8883 81/473 |
| 2013/0205569 | A1 * | 8/2013 | Nino | A61B 17/8883 29/460 |
| 2013/0226192 | A1 * | 8/2013 | Nino | A61B 19/30 606/104 |

* cited by examiner

*Primary Examiner* — David B Thomas

(57) ABSTRACT

A tool is configured to receive a locknut of a coaxial cable. The tool includes a sleeve provided with a first inner hole therein; a first block in the first inner hole, wherein the first block has a gradually small cross-sectional area from top to bottom in an axis of the first inner hole; a second block in the first inner hole, wherein the second block has a gradually small cross-sectional area from top to bottom in the axis of the first inner hole; and a third block in the first inner hole, wherein the third block has a gradually small cross-sectional area from bottom to top in the axis of the first inner hole, wherein the third block is configured to be between the first and second blocks, wherein the third block has a first surface configured to contact the first block and a second surface configured to contact the second block.

20 Claims, 20 Drawing Sheets

HAND TOOL

The present application is a continuation-in-part of application Ser. No. 13/137,644, filed on Aug. 31, 2011, now pending, all of which are incorporated herein by reference in its entity.

BACKGROUND OF THE DISCLOSURE

1. Field of the Disclosure

The disclosure relates to a hand tool and, more particularly, to a hand tool for fastening a locknut of a coaxial cable to a connection screw rod of an electrical connector at an electronic device of a cable TV system. When the hand tool has a socket operating to reach a predetermined torque value, the hand tool may automatically run idle and thereby the locknut of the coaxial cable, received in the socket, has a corner that may be prevented from being damaged.

2. Brief Description of the Related Art

CATV (Community antenna television or community access television) is known as cable TV that brings television programs to people throughout the world who are connected to a community antenna. Cable television provides television programs to consumers via radio frequency signals transmitted to televisions through coaxial cables or digital light pulses through fixed optical fibers located on the subscriber's property. In addition to bringing television programs to consumers, cable TV is a good way to interact with the World Wide Web and other new forms of multimedia information and entertainment services.

Further, when a coaxial cable is connected to a signal distributor, a locknut locks the signal connector at the end of the coaxial cable to a mating electrical connector at the signal distributor. During installation, a wrench has a socket for receiving the locknut so as to fasten tight the locknut. However, when a user presses a link of the wrench to rotate the socket for fastening the locknut to the mating electrical connector at the signal distributor, an excessive high pressure may be applied and causes the locknut or the socket to be damaged. When the locknut or the socket starts to wear, the user may be unable to rotate the locknut positively. Thus, this design of wrench is not durable in use.

SUMMARY OF THE DISCLOSURE

The present invention provides a hand tool for fastening a locknut of a coaxial cable to a connection screw rod of an electrical connector at an electronic device of a cable TV system. When the hand tool has a socket operating to reach a predetermined torque value, the hand tool may automatically run idle and thereby the locknut of the coaxial cable, received in the socket, has a corner that may be prevented from being damaged.

In an example of the present invention, a hand tool is provided to receive a locknut of a coaxial cable. The tool comprises: a sleeve provided with a first inner hole therein extending in an axis; a cylindrical body in the first inner hole, wherein the cylindrical body has a first flat surface vertical to the axis; a first block in the first inner hole, wherein the first block downwardly protrudes from the first flat surface; a second block in the first inner hole; and a third block in the first inner hole, wherein the first block is configured to be between the second and third blocks, wherein the first block has a first surface configured to contact the second block and a second surface configured to contact the third block, wherein an angle between the first surface of the first block and the first flat surface is less than that between the second surface of the first block and the first flat surface, wherein the first block is integral with the cylindrical body and non-integral with the sleeve, and the second block is integral with the third block and non-integral with the sleeve, first block and cylindrical body, wherein the second and third blocks are at a bottom of the first inner hole.

In an example of the present invention, a tool is configured to receive a locknut of a coaxial cable. The tool includes a sleeve provided with a first inner hole therein; a first block in the first inner hole, wherein the first block has a gradually small cross-sectional area from top to bottom in an axis of the first inner hole; a second block in the first inner hole, wherein the second block has a gradually small cross-sectional area from top to bottom in the axis of the first inner hole; and a third block in the first inner hole, wherein the third block has a gradually small cross-sectional area from bottom to top in the axis of the first inner hole, wherein the third block is configured to be between the first and second blocks, wherein the third block has a first surface configured to contact the first block and a second surface configured to contact the second block.

In an example of the present invention, a tool is provided to receive a locknut of a coaxial cable. The tool includes a rod provided with a first inner hole therein; a first shaft body having an inner portion in the first inner hole, wherein the inner portion of the first shaft body joins the rod; and a second shaft body having a step abutting against a step of the first shaft, wherein the steps of the first and second shaft bodies are in the first inner hole.

In an example of the present invention, a tool is provided to receive a locknut of a coaxial cable. The tool includes a sleeve provided with a first inner hole therein; a cylindrical body in the first inner hole; a shaft body joining the cylindrical body, wherein the cylindrical body has a diameter greater than that of the shaft body; a first bushing sleeved around the shaft body and joining the sleeve, wherein a second inner hole axially through the first bushing receives the shaft body and has a diameter smaller than that of the first inner hole; and a spring sleeved around the shaft body and arranged between the cylindrical body and the first bushing.

In an example of the present invention, a hand tool is provided to receive a locknut of a coaxial cable. The hand tool includes a first block and a second block fitting with the first block, wherein the first block has a first surface that is movable along a first surface of the second block and the first block is movable relatively to the second block in an axial direction of the hand tool when the hand tool is used to rotate the locknut of the coaxial cable in a first rotation direction, wherein the first block has a second surface that abuts against a second surface of the second block and the first block is not movable relatively to the second block when the hand tool is used to rotate the locknut of the coaxial cable in a second rotation direction These, as well as other components, steps, features, benefits, and advantages of the present disclosure, will now become clear from a review of the following detailed description of illustrative embodiments, the accompanying drawings, and the claims.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same reference number or reference indicator appears in different drawings, it may refer to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
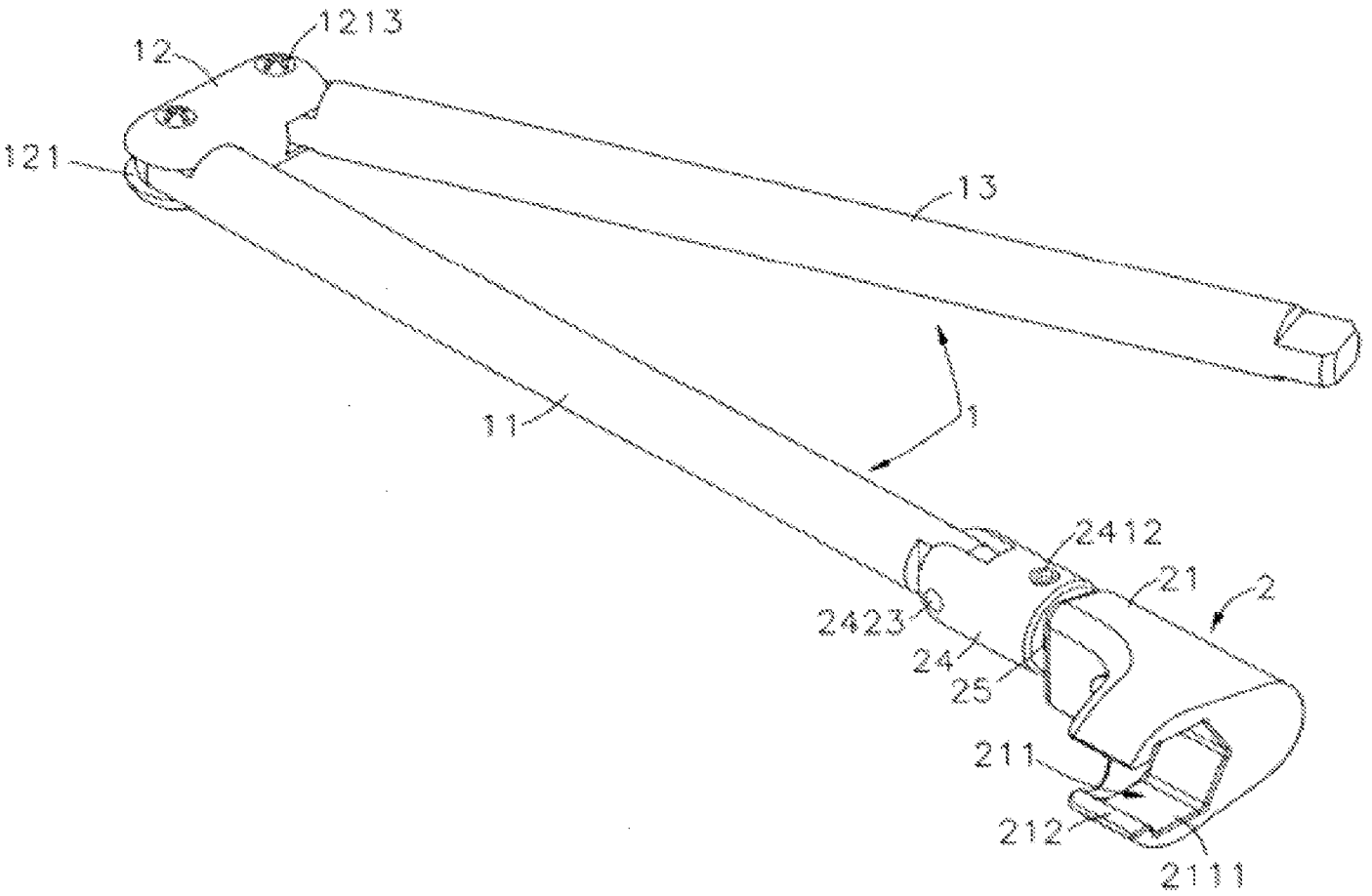
FIG. 1 is a perspective view showing a hand tool in accordance with a first embodiment of the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

First Embodiment

Figure 2:
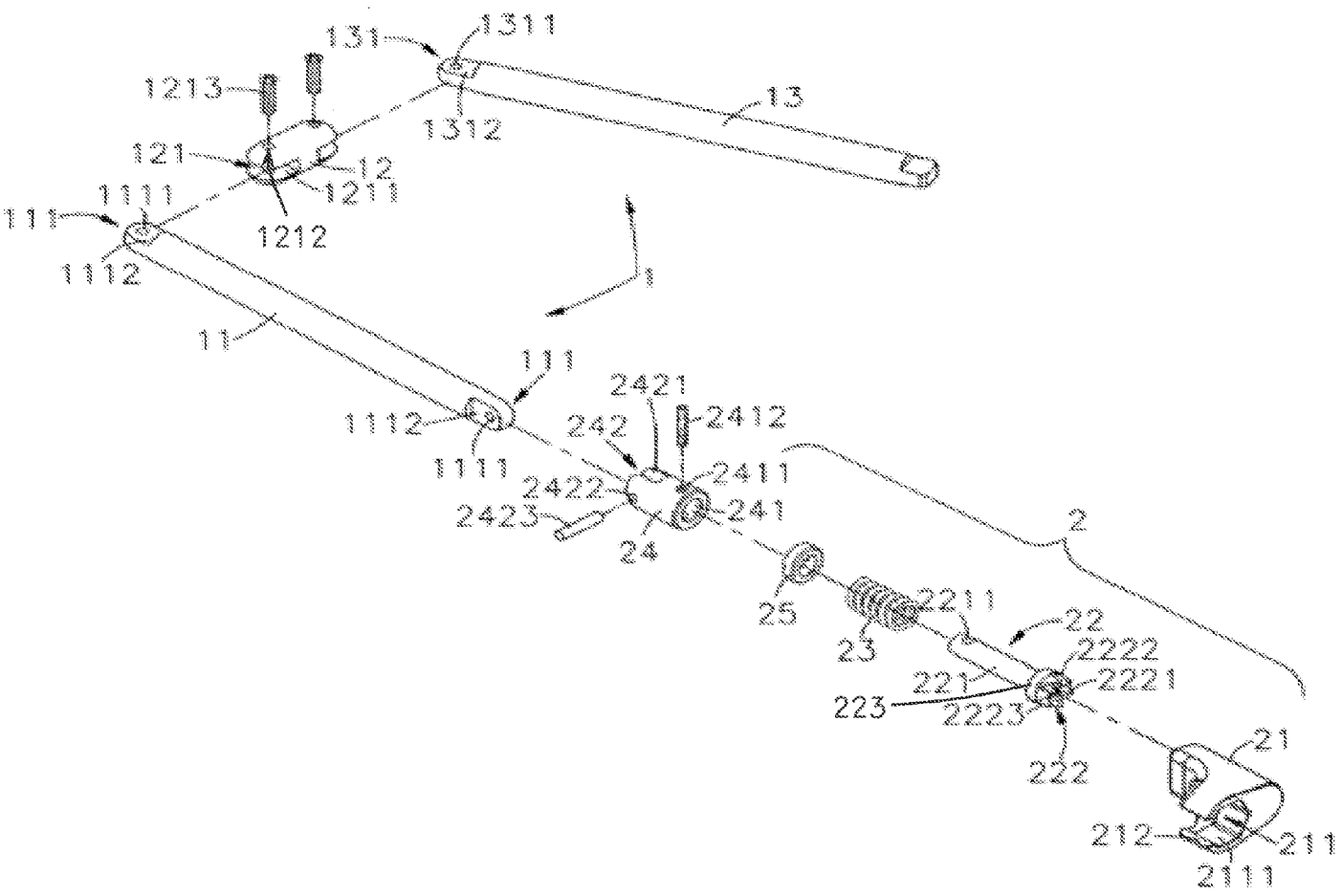
FIG. 2 is a perspective exploded view showing a hand tool in accordance with the first embodiment of the present invention.
Figure 3:
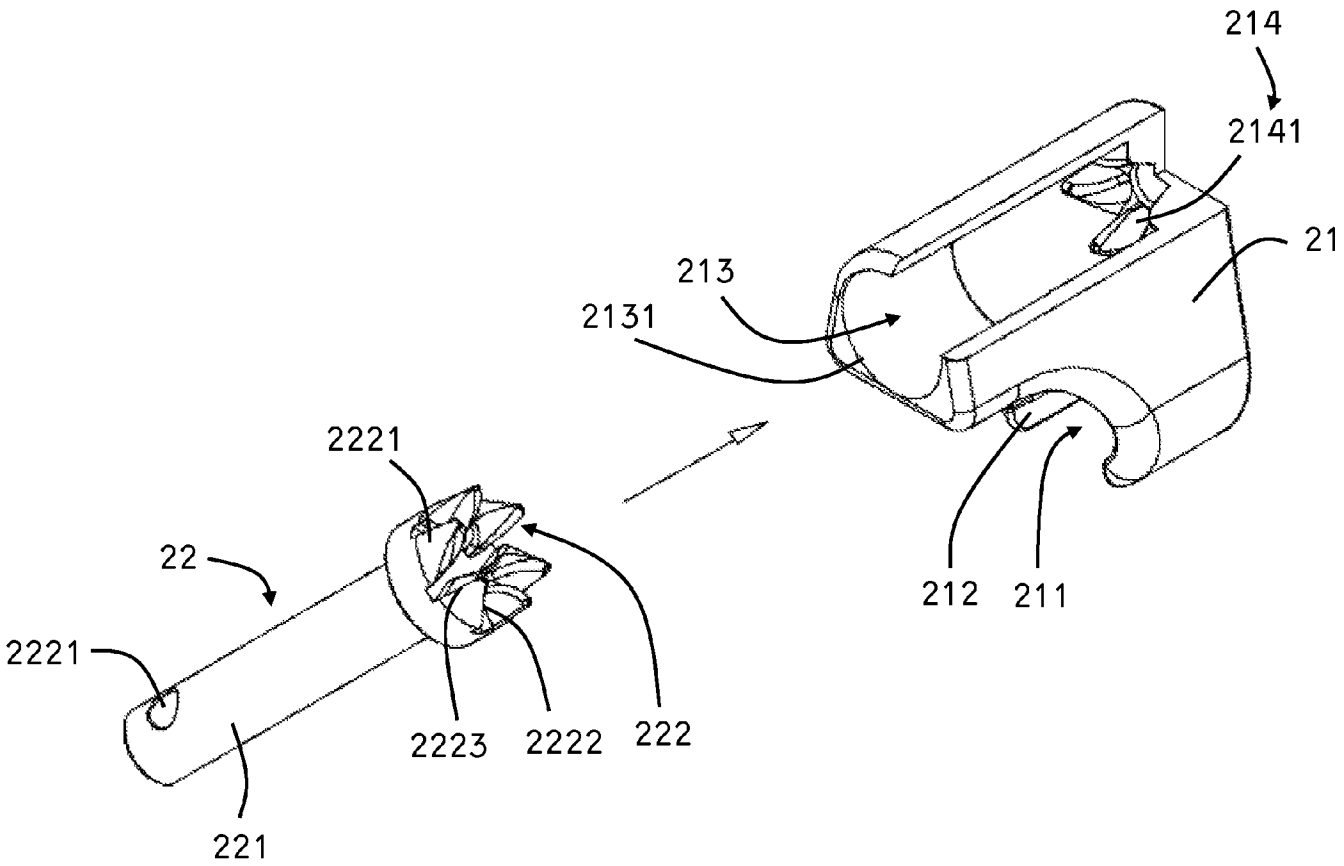
FIG. 3 is schematically perspective view showing the assembly of a rotating shaft and a sleeve in accordance with the present invention.
Figure 4:
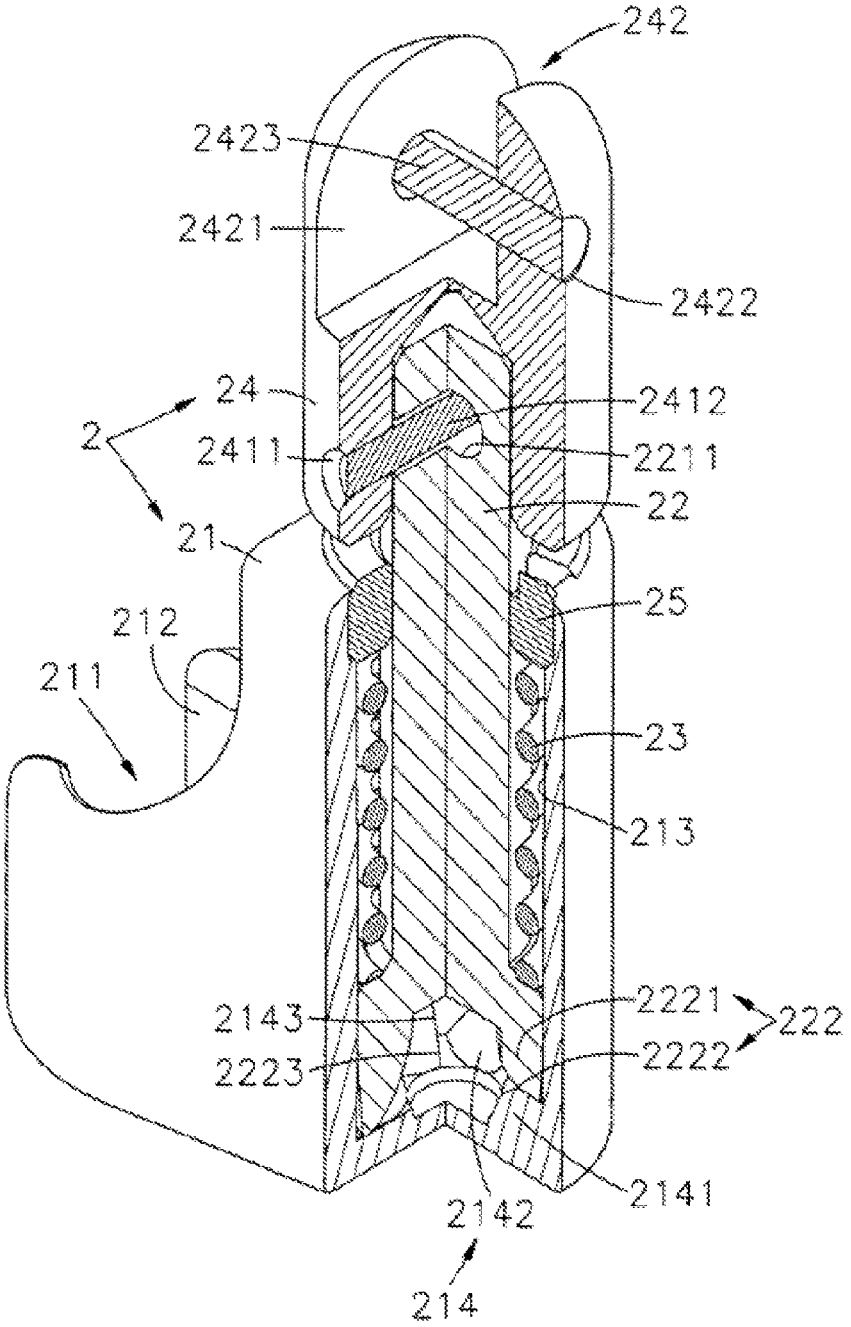
FIG. 4 is a perspective cross-sectional view showing parts of the hand tool in accordance with the first embodiment of the present invention.

In the first embodiment, FIG. 1 is a perspective view showing a hand tool in accordance with a first embodiment of the present invention; FIG. 2 is a perspective exploded view showing a hand tool in accordance with the first embodiment of the present invention; FIG. 3 is schematically perspective view showing the assembly of a rotating shaft and a sleeve in accordance with the present invention; FIG. 4 is a perspective cross-sectional view showing parts of the hand tool in accordance with the first embodiment of the present invention. Referring to FIGS. 1-4, the hand tool in accordance with the first embodiment of the present invention is shown comprising a tool shaft 1 and a tool head 2.

The tool shaft 1 comprises a shank 11, a handle 13, a coupling block 12 coupled between the shank 11 and the handle 13, and two pivot screws 1213. The shank 11 comprises two coupling end portions 111 respectively located on the two distal ends thereof. Each coupling end portion 111 comprises two opposing cut planes 1112 and a pivot hole 1111 cut through the opposing cut planes 1112. The pivot holes 1111 passing through the two coupling end portions 111 extend in different directions, for example, at a right angle. The coupling block 12 may have a shape like a shaft, a cube or a ball. In this embodiment, the coupling block 12 has a shape like a shaft.

The handle 13 comprises a coupling end portion 131 located on one end thereof. The coupling end portion 131 comprises two opposing cut planes 1312 and a pivot hole 1311 cut through the opposing cut planes 1312.

Two coupling notches 121 in the coupling block 12 are symmetrically disposed at two opposite sides, wherein each of the coupling notches 121 is between a corresponding pair of opposing flat inside walls 1211 disposed at a corresponding side of the coupling block 12, and two screw holes 1212 extending through the two respective pairs of opposing flat inside walls 1211. The two coupling notches 121 receive the coupling end portion 111 of the shank 11 at a first distal end thereof and the coupling end portion 131 of the handle 13. A pivot screw 1213 is threaded into the screw holes 1212 at an end of the coupling block 12 and inserted through the pivot hole 1111 in one coupling end portion 111 of the shank 11 at the first distal end thereof to pivotally connect the shank 11 and the coupling block 12 together, keeping the opposing cut planes 1112 of the respective coupling end portion 111 of the shank 11 in close contact with the respective flat inside walls 1211 at the end of the coupling block 12. Another pivot screw 1213 is threaded into the screw holes 1212 at the other end of the coupling block 12 and inserted through the pivot hole 1311 in the coupling end portion 131 of the handle 13 to pivotally connect the handle 13 and the coupling block 12 together, keeping the opposing cut planes 1312 of the coupling end portion 131 of the handle 13 in close contact with the respective flat inside walls 1211 at the other end of the coupling block 12. The handle 13 is rotated relatively to the coupling block 12 in substantially the same plane as the shank 11 is rotated relatively to the coupling block 12.

In this embodiment, the handle 13 has a length greater than that of the shank 11 having a length greater than that of the coupling block 12. Alternatively, the handle 13, shank 11 and coupling block 12 may have another length. For example, the shank 11 has a length greater than that of the handle 13 having a length greater than that of the coupling block 12. For example, the coupling block 12 has a length greater than that of the handle 13 having a length greater than that of the shank 11.

The tool head 2 is coupled to the other coupling end portion 111 of the shank 11 of the tool shaft 1, comprising a socket or sleeve 21, a transmission shaft 22, an elastic member, for example, a compression spring 23, and a connection member 24.

Figure 5:
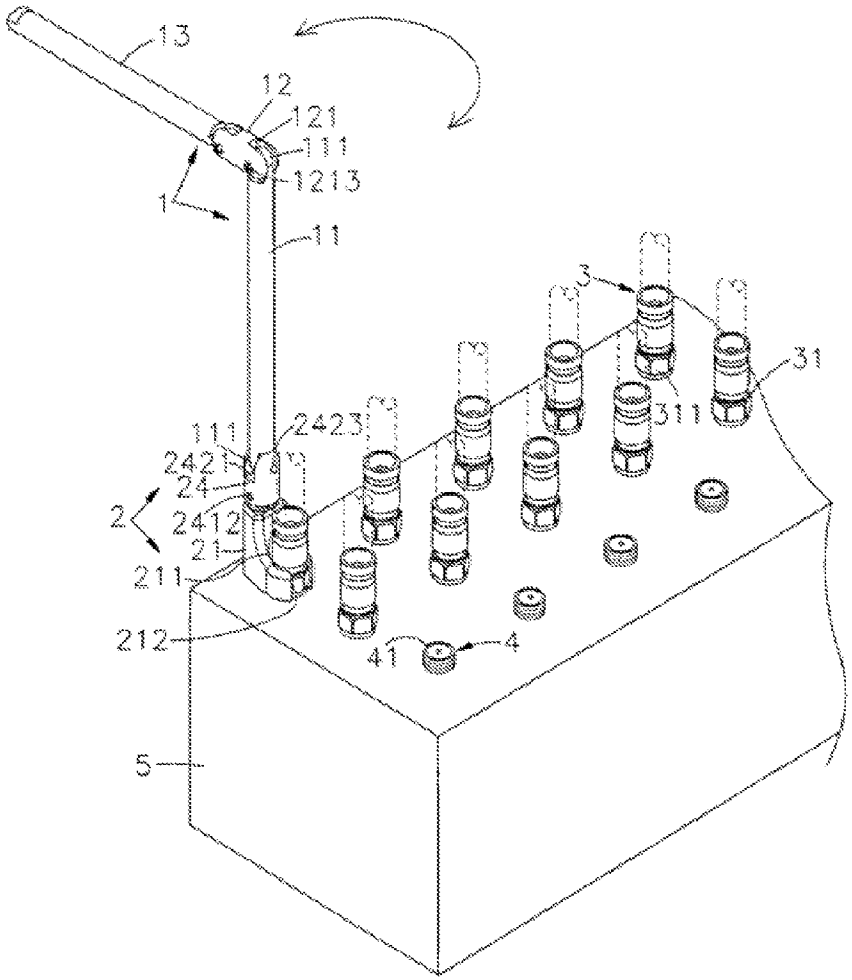
FIG. 5 is a perspective view showing the operating hand tool in accordance with the first embodiment of the present invention.

A non-enclosed ring or C-shaped surrounds a socket hole 211 extending axially beside the receiving hole 213 is integral with the sleeve 21, wherein the non-enclosed ring has at least one pair of opposing bearing portions 2111 attachable to a locknut 31 of a coaxial cable 3 for fastening or loosening the locknut 31, as shown in FIG. 5. A side opening 212 between two ends of the non-enclosed ring laterally communicates with the socket hole 211. A receiving hole 213 is arranged in the sleeve 21 and laterally beside the socket hole 211.

Referring to FIGS. 6-9, a driven structure 214, i.e. blocking member, is located at a bottom of the receiving hole 213, opposite to a top opening 2131 at a top of the receiving hole 213, wherein the blocking member 214 is integral with the sleeve 21. The driven structure or blocking member 214 includes multiple stop blocks 2141 integral with the sleeve 21, where the stop blocks 2141 inwardly and upwardly protrudes from an inner bottom surface 215 of the sleeve 21 substantially vertical to an axis of the receiving hole 213. The stop blocks 2141 are arranged in a ring. Each stop block 2141 has an opposing push face 2142 and a vertical stop face 2143 substantially parallel with the axis of the receiving hole 213. An angle between the push face 2142 and the vertical stop face 2143 may range from 25 to 60 degrees or range from 30 to 45 degrees, for example. A slope angle between the vertical stop face 2143 and the inner bottom surface 215 is greater than that between the push face 2142 and the inner bottom surface 215. The slope angle between the vertical stop face 2143 and the inner bottom surface 215 may be a substantially right angle or range from 75 to 90 degrees, for example. The slope angle between the push face 2142 and the inner bottom surface 215 may range from 15 to 75 degrees. Alternatively, the push face 2142 may be a curved surface with a gradually small slope from bottom to top with respect to the inner bottom surface 215.

The transmission shaft 22 has a portion accommodated in the receiving hole 213 in the socket 21. The transmission shaft 22 includes a shaft body 221 and a driving head 222 located at an end of the shaft body 221 for engagement with the driven structure 214 of the socket 21. The driving head 222 includes a cylindrical body 223 with a lower flat surface 2231 vertical to the axis of the receiving hole 213 and multiple tooth blocks 2221 downwardly and inwardly protruding from the lower flat surface 2231 of the cylindrical body 223. The tooth blocks 2221 are arranged in a ring. The cylindrical body 223 has an upper flat surface 2232 joining a lower end of the shaft body 221. The cylindrical body 223 is integral with the shaft body 221 and the tooth blocks 2221. Each tooth block 2221 has a slope face 2222 and a vertical face 2223. An angle between the slope face 2222 and the vertical face 2223 may range from 25 to 60 degrees or range from 30 to 45 degrees, for example. A slope angle between the vertical face 2223 and the lower flat surface 2231 is greater than that between the slope face 2222 and the lower flat surface 2231. The slope angle between the vertical face 2223 and the lower flat surface 2231 may be a substantially right angle or range from 75 to 90 degrees, for example. The slope angle between the slope face 2222 and the lower flat surface 2231 may range from 15 to 75 degrees. Alternatively, the slope face 2222 may be a curved surface with a gradually small slope from top to bottom with respect to the lower flat surface 2231.

The compression spring 23 is sleeved onto and around the shaft body 221 of the transmission shaft 22 and has a lower end stopped at the upper flat surface 2232 of the driving head 222. The connection member 24 is coupled to the other end of the shaft body 221 at a second distal end thereof. An insertion hole 241 axially extending through the connection member 24 from a lower end of the connection member 24 for receiving the other end of the shaft body 221 of the transmission shaft 22. A mounting screw hole 2411 radially extends through the connection member 24 and transversely extends across the insertion hole 241. A screw rod 2412 threaded into the mounting screw hole 2411 and inserted through a coupling hole 2211 radially extending through the shaft body 221 of the transmission shaft 22 at an upper end thereof to connect the connection member 24 to the transmission shaft 22. A flat coupling notch 242 disposed at an upper end of the connection member 24 is provided between two opposing flat inside walls 2421 of the connection member 24, arranged substantially in parallel. A pin hole 2422 radially extends through the two opposing flat inside walls 2421 and transversely extends across the flat coupling notch 242. A pin 2423 is press-fitted into the pin hole 2422 and inserted through the pivot hole 1111 through the other coupling end portion 111 of the shank 11 at the second distal end thereof to pivotally connect the shank 11 of the tool shaft 1 to the connection member 24. Further, the diameter of the coupling hole 2211 through the shaft body 221 of the transmission shaft 22 is greater than the maximum outer diameter of the screw rod 2412 so that the transmission shaft 22 is slightly movable relative to the connection member 24 within a limited range. The connection member 24 is rotated relatively to the shank 11 in a plane substantially vertical to the plane, in which the shank 11 is rotated relatively to the coupling block 12 and in which the handle 13 is rotated relatively to the coupling block 12.

The hand tool further comprises an axle bushing 25 having a threaded portion at a circumference thereof engaged with a threaded portion of an inner wall of the sleeve 21 and at an upper opening 2131 of the receiving hole 213 in the sleeve 21. The axle bushing 25 is sleeved onto and around the shaft body 221 of the transmission shaft 22 and stopped at an upper end of the compression spring 23 against the cylindrical body 223 of the transmission shaft 22, that is, an inner hole axially through the axle bushing 25 receives the shaft body 221 of the transmission shaft 22 and has a diameter smaller than that of the receiving hole 213. The axle bushing 25 is not a requisite member. Alternatively, the compression spring 23 may be mounted around the shaft body 221 of the transmission shaft 22 and stopped between the cylindrical body 223 of the transmission shaft 22 and the connection member 24. Alternatively, a plurality of the axle bushing 25, the number of which may be two for example, may be sequentially arranged at the upper opening 2131 of the receiving hole 213 for improving the attachment of the plurality of the axle bushing 25 to the sleeve 21 and for preventing the threaded portion of the inner wall of the sleeve 21 from being damaged. Each of the plurality of the axle bushing 25 has a threaded portion at a circumference thereof engaged with the threaded portion of the inner wall of the sleeve 21.

Figure 6:
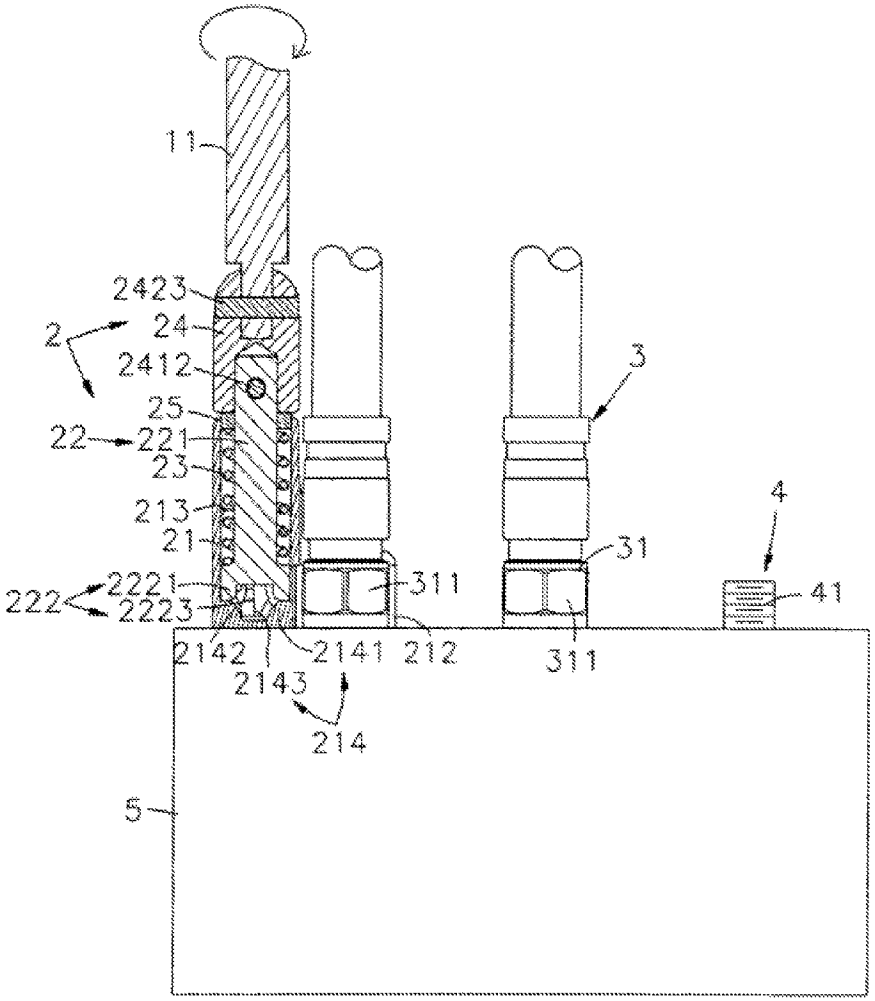
FIG. 6 is a side cross-sectional view showing the hand tool operating with a coaxial cable connector in accordance with the first embodiment of the present invention.
Figure 7:
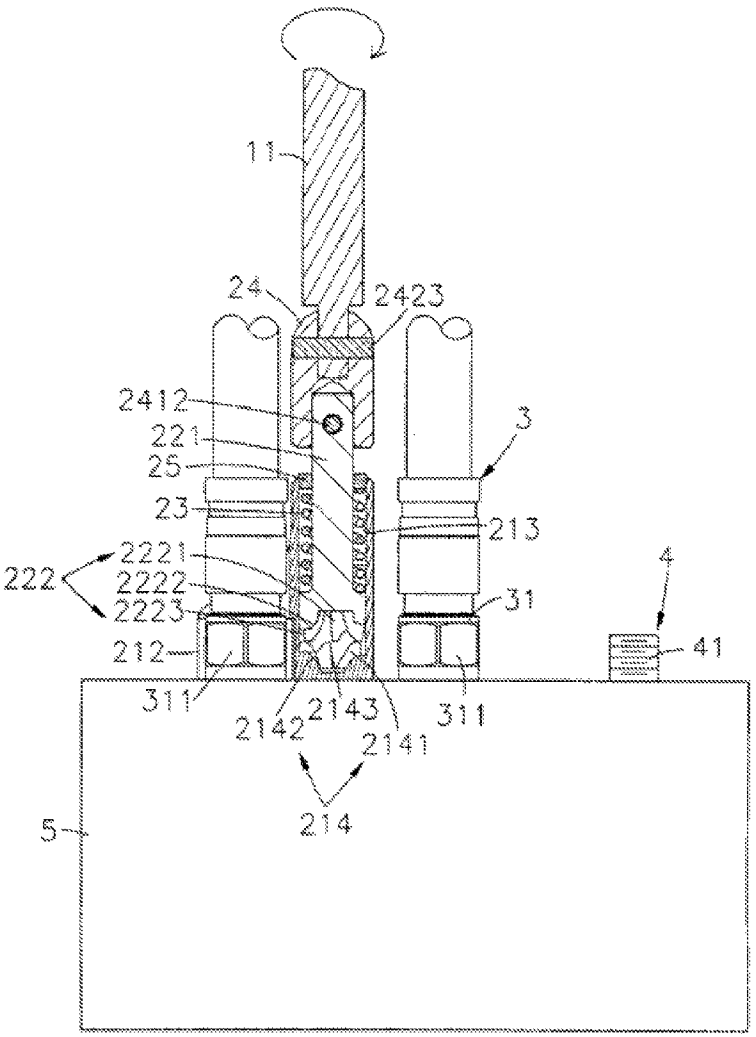
FIG. 7 is a side cross-sectional view showing the hand tool operating with a coaxial cable connector in accordance with the first embodiment of the present invention.

FIG. 5 is a perspective view showing the operating hand tool in accordance with the first embodiment of the present invention. FIG. 6 is a side cross-sectional view showing the hand tool operating with a coaxial cable connector in accordance with the first embodiment of the present invention. FIG. 7 is a side cross-sectional view showing the hand tool operating with a coaxial cable connector in accordance with the first embodiment of the present invention. Referring to FIGS. 5-7, the hand tool of the invention is practical for use in a cable TV system for fastening a coaxial cable 3 to one connection screw rod 41 of an electrical connector 4 at an electronic device 5, such as signal distributor or adapter. During installation, a center conductor (not shown) of a coaxial cable 3 is inserted into a center contact hole in a connection screw rod 41 of an electrical connector 4, the locknut 31 of the coaxial cable 3 is threaded onto the connection screw rod 41 of the electrical connector 4 by a labor, and then the socket hole 211 beside the sleeve 21 of the hand tool is attached to the locknut 31 so as to tightly fasten the locknut 31 to the connection screw rod 41 of the electrical connector 4. By means of the side opening 212, the locknut 31 can be laterally inserted into the socket hole 211 and a hexagonal periphery 311 of the locknut 31 may abut against the opposing bearing portions 2111 of the non-enclosed ring. At this time, the user can hold the handle 13 at about 90-degree angle relative to the shank 11 and then operate the handle 13 to rotate the shank 11 and the tool head 2 in a clockwise direction, thereby fastening up the locknut 31. Subject to the coupling arrangement of the coupling block 12 between the shank 11 and the handle 13 and the coupling arrangement between the connection member 24 of the tool head 2 and the shank 11 of the tool shaft 1, the handle 13 can be operated to any desired angle relative to the sleeve 21 to fit different installation conditions, facilitating application in a narrow space. The locknut 31 may have a hexagonal periphery, pentagonal periphery, circular periphery, square periphery or polygonal periphery and thereby the socket hole 211 may have a corresponding shape for fitting with the alternative locknut 31. The locknut 31 may have a rough surface.

Figure 9:
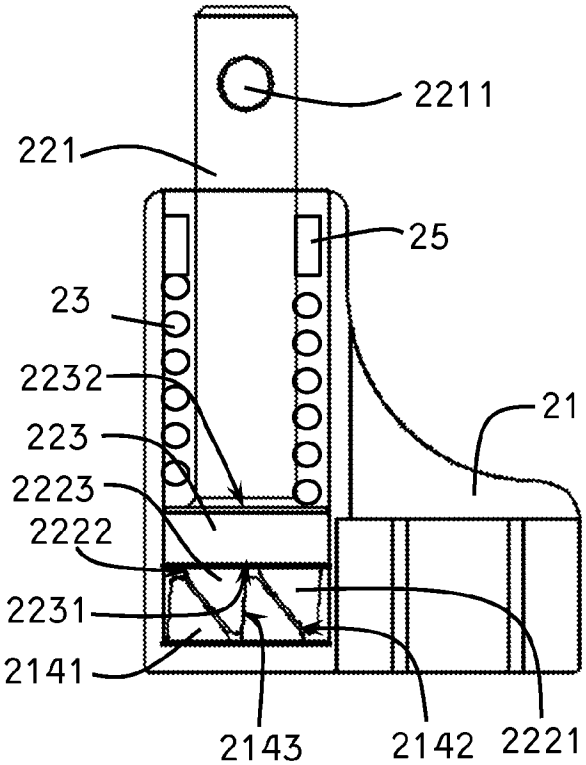
FIG. 9 is a schematic view showing the tooth block of the transmission shaft operates with the stop block of the sleeve in accordance with the first embodiment of the present invention when the hand tool is used to loose a nut of a coaxial cable connector off the electronic device.

Referring to FIG. 9, during application of the hand tool, the compression spring 23 imparts a pressure to the cylindrical body 223 of the transmission shaft 22 in a direction away from the axle bushing 25 (or the connection member 24), forcing the tooth blocks 2221 of the driving head 222 into positive engagement with the stop blocks 2141 of the driven structure 214, and therefore the sleeve 21 can be positively driven by the tool shaft 1 to rotate the locknut 31 of the coaxial cable 3 relatively to the connection screw rod 41 of the electrical connector 4 of the electronic device 5 to fasten tight or loosen the locknut 31.

Figure 8:
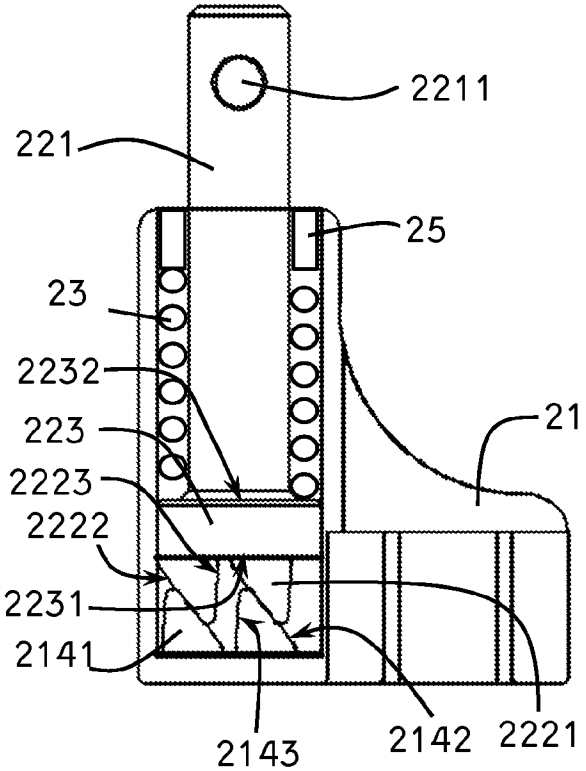
FIG. 8 is a schematic view showing a tooth block of a transmission shaft operates with a stop block of a sleeve in accordance with the first embodiment of the present invention when the hand tool is used to lock a nut of a coaxial cable connector to an electronic device with reaching a predetermined torque value.

Referring to FIG. 8, when the socket hole 211 reaches a predetermined torque value during rotation of the locknut 31 relatively to the connection screw rod 41 of the electrical connector 4 of the electronic device 5, the slope faces 2222 of the tooth blocks 2221 of the driving head 222 of the transmission shaft 22 abut against the push faces 2142 of the respective stop blocks 2141 of the driven structured 214 of the sleeve 21. When continuously rotating the transmission shaft 22 by applying force to the handle 13 at this time, the slope faces 2222 of the tooth blocks 2221 of the driving head 222 may move along the push faces 2142 of the stop blocks 2141 of the driven structure 214 of the sleeve 21 such that the transmission shaft 22 may be driven to upwardly move along the axis of the receiving hole 213 far away from the bottom surface 215 of the sleeve 21 and to press the compression spring 23 without the rotation of the locknut 31 relatively to the connection screw rod 41 of the electrical connector 4 of the electronic device 5. Thereby, the hand tool may run idle. Accordingly, the hexagonal periphery 311 of the locknut 31 and the socket hole 211 may be avoided from being damaged due to extremely large force applied thereto. Durability of the hand tool may be enhanced. When still continuously rotating the transmission shaft 22 by applying force to the handle 13 at this time, each of the tooth blocks 2221 of the driving head 222 rotates across over the corresponding stop block 2141 of the driven structured 214 and is driven, by the pressure of the compression spring 23 against the cylindrical body 223 of the transmission shaft 22, to promptly downwardly move along the axis of the receiving hole 213 toward the bottom surface 215 of the sleeve 21 and contact another one of the stop blocks 2141, creating a knocking sound. Accordingly, the hand tool may have improved life span.

Referring to FIG. 9, when the user wishes to loosen the locknut 31 of the coaxial cable 3 from the connection screw rod 41 of the electrical connector 4 of the electronic device 5, the opposing bearing portions 2111 of the non-enclosed ring is attached to the hexagonal periphery 311 of the locknut 31, and then the handle 13 may be operated to rotate the shank 11 and tool head 2 in a counterclockwise direction such that the vertical faces 2223 of the tooth blocks 2221 of the transmission shaft 22 of the tool head 2 abut against the respective vertical stop faces 2143 of the stop blocks 2141 of the driven structured 214 of the sleeve 21. Thereby, the sleeve 21 and the transmission shaft 22 may be driven to simultaneously rotate so as to lead the locknut 31 to rotate relatively to the connection screw rod 41 of the electrical connector 4. When the locknut 31 is being loosened, the opposing bearing portions 2111 of the non-enclosed ring abut against the hexagonal periphery 311 of the locknut 31, enabling the locknut 31 to be rotated by the sleeve 21 positively without causing damage. Further, the sleeve 21, the transmission shaft 22 and the compression spring 23 are detachable, facilitating replacement of a different design of sleeve or a compression spring having a different coefficient of elasticity to fit different application requirements and predetermined torque values based on various types or sizes of locknuts.

Thus, when the user is going to loosen the locknut 31 of the coaxial cable 3, the user simply needs to rotate the handle 13 of the tool shaft 1 in the reversed direction. Subject to abutment between the vertical faces 2223 of the tooth blocks 2221 and the vertical stop faces 2143 of the stop blocks 2141 and abutment between the opposing bearing portions 2111 of the non-enclosed ring and the hexagonal periphery 311 of the locknut 31 of the coaxial cable 3, the sleeve 21 is driven by the transmission shaft 22 to rotate the locknut 31 of the coaxial cable 3 positively. The hexagonal periphery 311 of the locknut 31 and the socket hole 211 may be avoided from being damaged due to extremely large force applied thereto. Even if the locknut 31 has been slightly worn, the sleeve 21 can still be used to positively rotate the locknut 31.

As mentioned above, each of the tooth blocks 2221 is between corresponding two of the stop blocks 2141; the each of the tooth blocks 2221 has a slope face 2222 configured to contact a push face 2142 of one of the corresponding two of the stop blocks 2141 and a vertical face 2223 configured to contact a vertical stop face 2143 of the other one of the corresponding two of the stop blocks 2141. In the other words, each of the stop blocks 2141 is between corresponding two of the tooth blocks 2221; the each of the stop blocks 2141 has a push face 2142 configured to contact a slope face 2222 of one of the corresponding two of the tooth blocks 2221 and a vertical stop face 2143 configured to contact a vertical face 2223 of the other one of the corresponding two of the tooth blocks 2221. Each of the tooth blocks 2221 has a gradually small cross-sectional area from top to bottom in the axis of the receiving hole 213. Each of the stop blocks 2141 has a gradually small cross-sectional area from bottom to top in the axis of the receiving hole 213. The stop blocks 2141 are integral with the sleeve 21 but non-integral with the tooth blocks 2221 and the cylindrical body 223. The stop blocks 2141 are at a bottom of the receiving hole 213.

Second Embodiment

Figure 10:
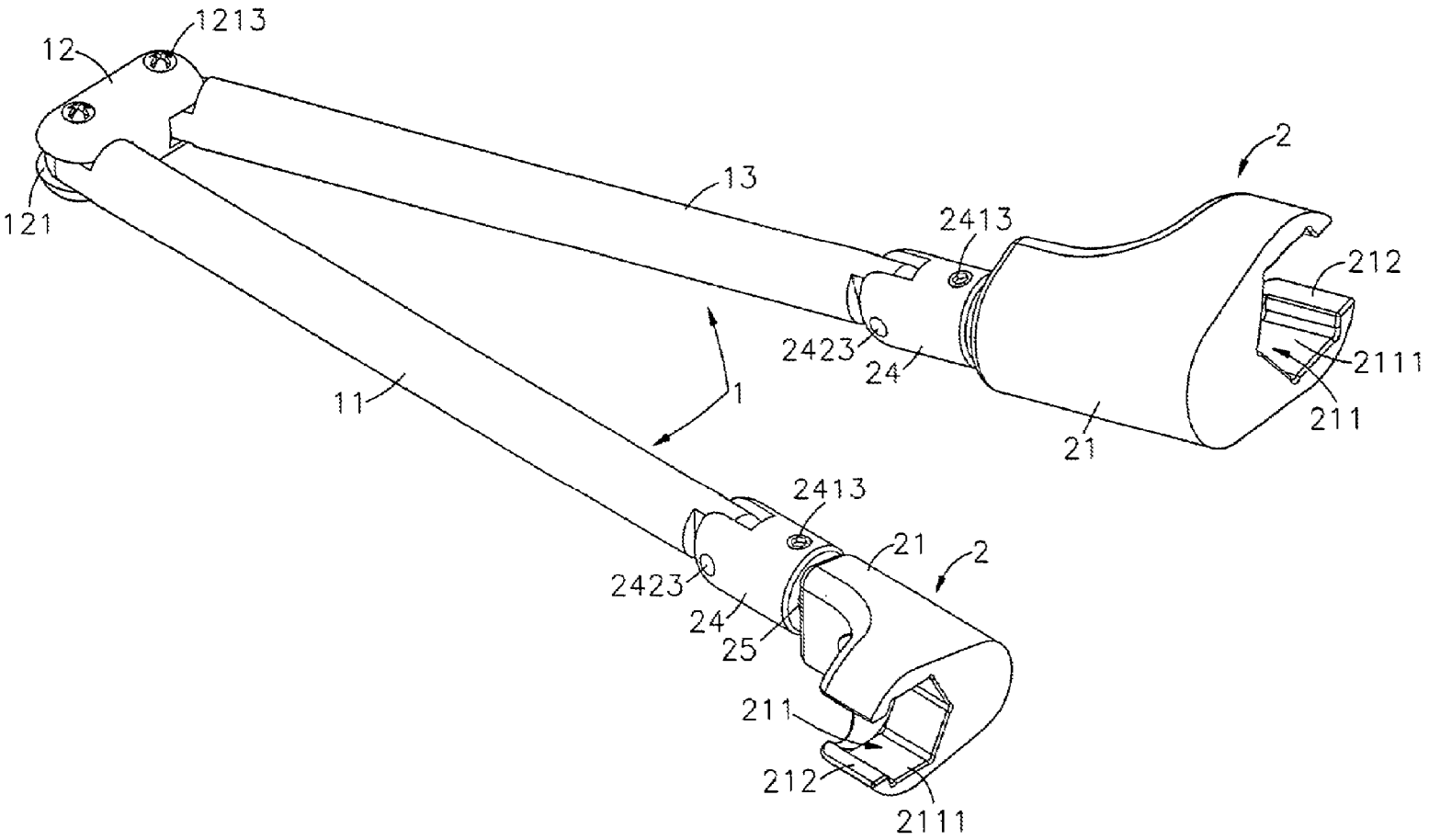
FIG. 10 is a perspective view showing a hand tool in accordance with a second embodiment of the present invention.

FIG. 10 is a perspective view showing a hand tool in accordance with a second embodiment of the present invention. According to this second embodiment, the hand tool comprises two tool heads 2 respectively coupled to the distal end of the shank 11 and the distal end of the handle 13. Similar to the aforesaid first embodiment of the present invention, each of the tool heads 2 in accordance with this second embodiment comprises the sleeve 21, the transmission shaft 22, an elastic member, such as the compression spring 23, and the connection member 24. The structural features of the sleeve 21, the transmission shaft 22, the compression spring 23 and the connection member 24 of each tool head 2 are the same as those in the aforesaid first embodiment of the present invention. Further, the sleeves 21 of the two tool heads 2 can be prepared subject to two different specifications or different patterns for rotating different locknuts. A socket hole 211 beside one of the sleeves 21 may fit with a hexagonal periphery of a locknut, and the other socket hole 211 beside the other one of the sleeves 21 may fit with a circular periphery of a locknut, for example.

Third Embodiment

Figure 11:
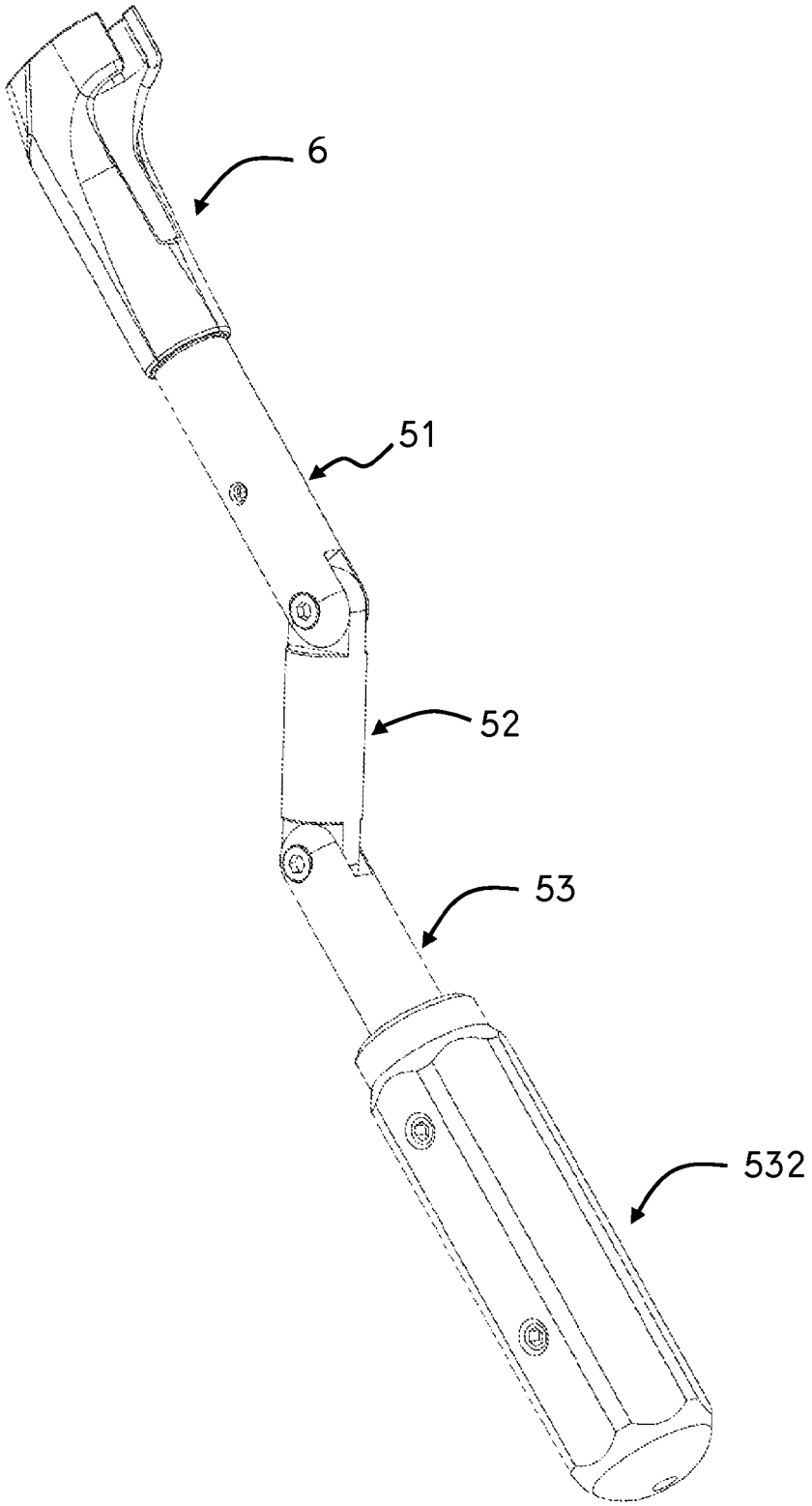
FIG. 11 is a perspective view showing a hand tool in accordance with a third embodiment of the present invention.
Figure 12:
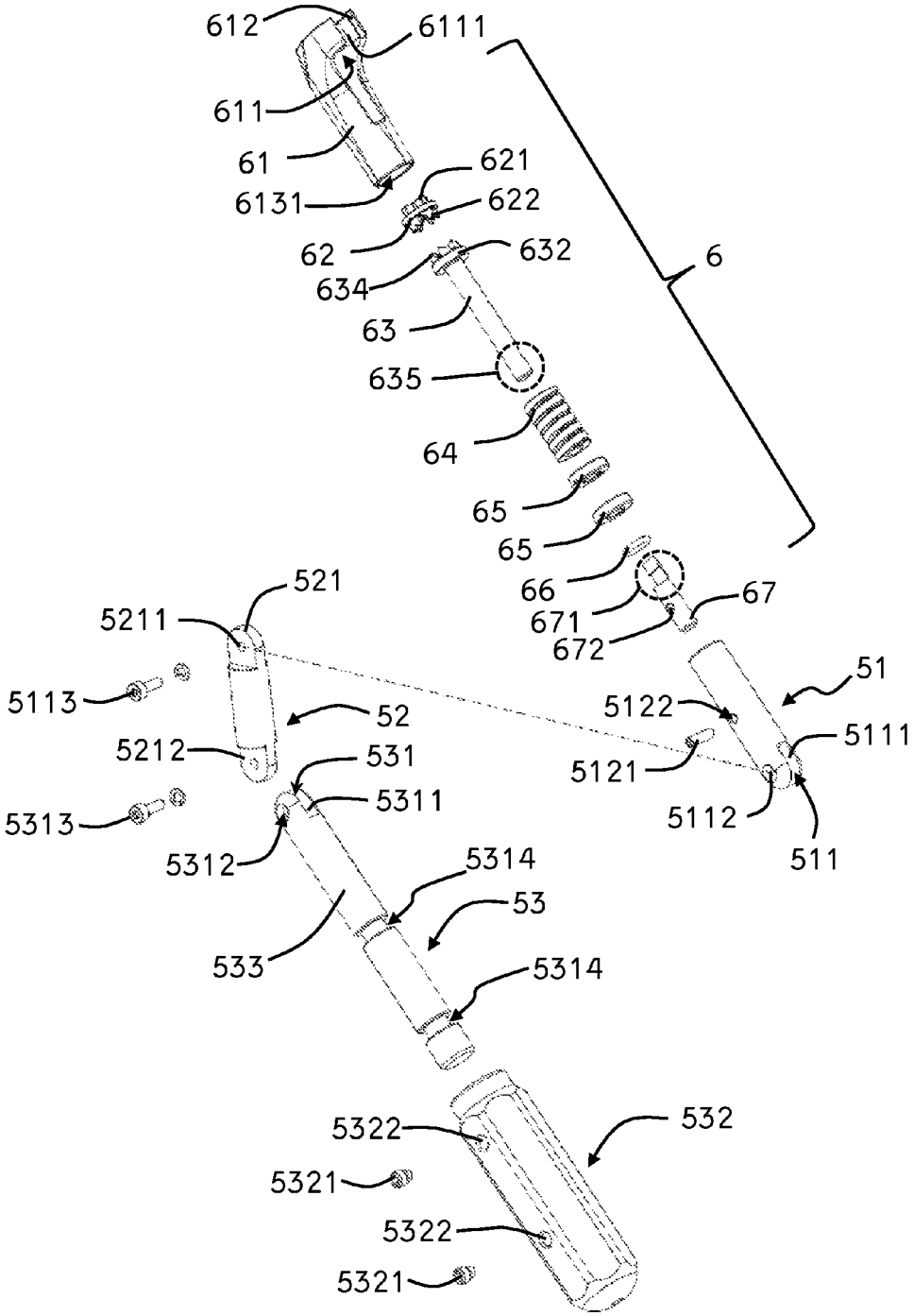
FIG. 12 is a perspective exploded view showing the hand tool in accordance with the third embodiment of the present invention.
Figure 13A:
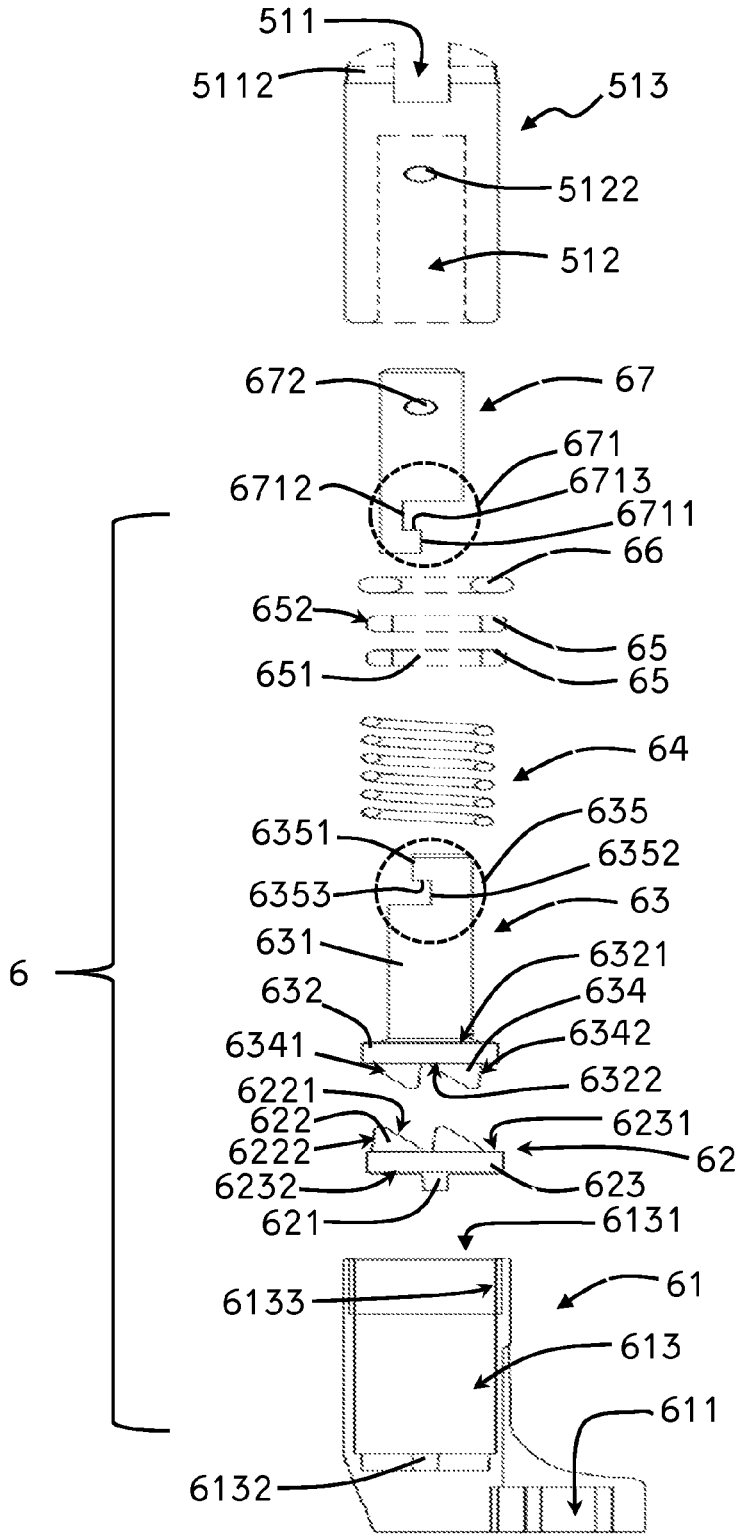
FIG. 13A is an exploded side view showing parts of a shank and a sleeve of the hand tool in accordance with the third embodiment of the present invention.
Figure 13C:
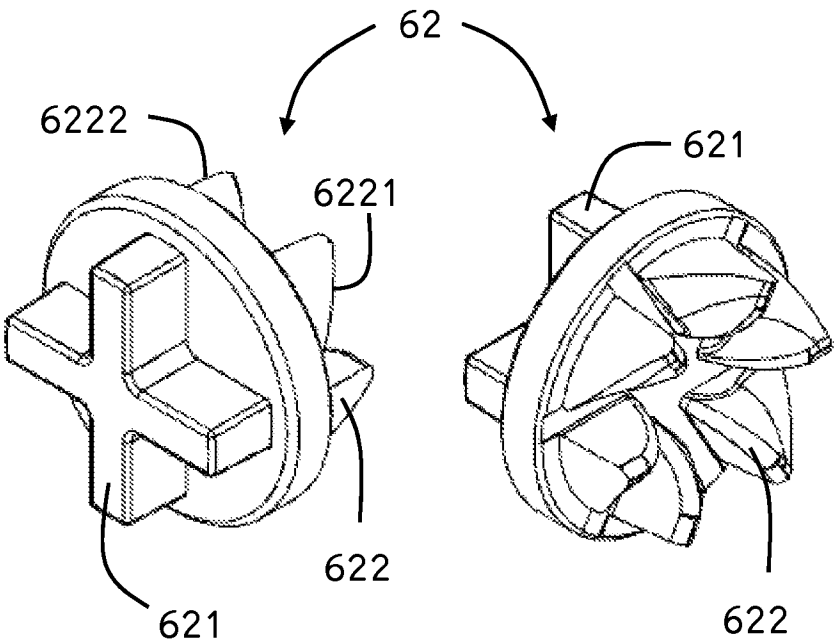
FIG. 13C are perspective views showing a blocking member of the hand tool in accordance with the third embodiment of the present invention.
Figure 13B:
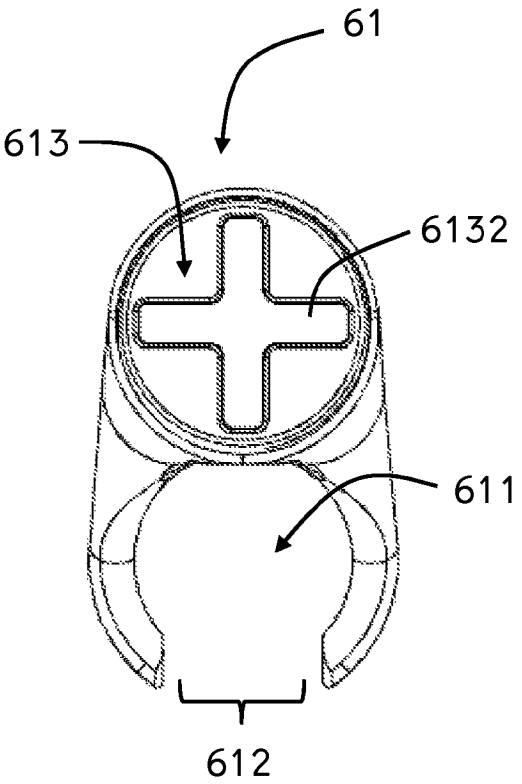
FIG. 13B is a top view showing a sleeve of the hand tool in accordance with the third embodiment of the present invention.
Figure 13D:
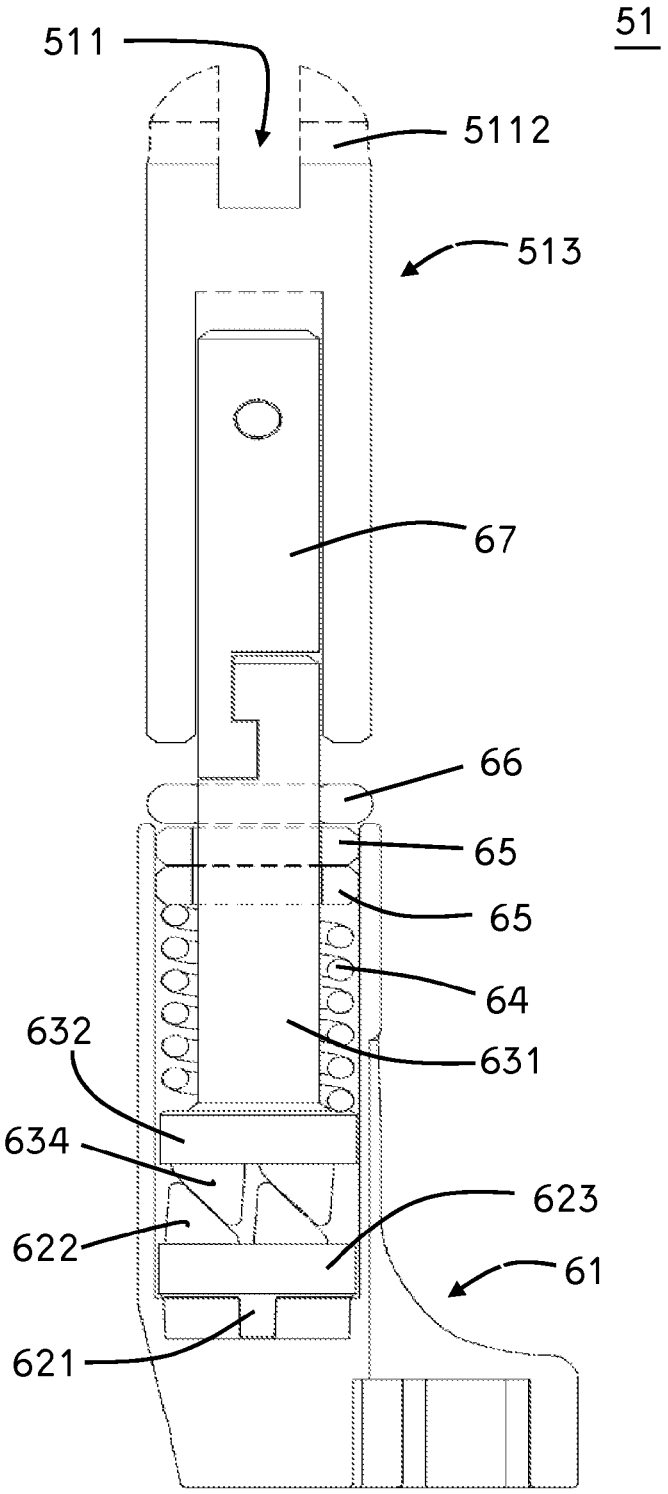
FIG. 13D is a side cross-sectional view showing the assembly of the shank and sleeve in accordance with the third embodiment of the present invention.

FIG. 11 is a perspective view showing a hand tool in accordance with a third embodiment of the present invention. FIG. 12 is a perspective exploded view showing the hand tool in accordance with the third embodiment of the present invention. FIG. 13A is an exploded side view showing parts of a shank and a sleeve of the hand tool in accordance with the third embodiment of the present invention. FIG. 13B is a top view showing a sleeve of the hand tool in accordance with the third embodiment of the present invention. FIG. 13C are perspective views showing a blocking member of the hand tool in accordance with the third embodiment of the present invention. FIG. 13D is a side cross-sectional view showing the assembly of the shank and sleeve in accordance with the third embodiment of the present invention. Referring to FIGS. 11, 12 and 13A-13D, the tool shaft comprises a shank 51, a handle 53 and a coupling block 52 coupled between the shank 51 and the handle 53. The coupling block 52 comprises two coupling end portions 521 respectively located on the two distal ends thereof. Each coupling end portion 521 comprises two opposing cut planes 5212 and a pivot hole 5211 cut through the opposing cut planes 5212. The pivot holes 5211 passing through the two coupling end portions 111 extend in the same directions. One of the coupling end portions 521 is pivotally coupled to the shank 51 and the other one of the coupling end portions 521 is pivotally coupled to the handle 53. The coupling block 52 may have a shape like a shaft, a cube or a ball. In this embodiment, the coupling block 52 has a shape like a shaft. The handle 53 is rotated relatively to the coupling block 52 in substantially the same plane as the shank 51 is rotated relatively to the coupling block 52.

Referring to FIGS. 11 and 12, in this embodiment, the handle 53 has a length greater than that of the shank 51 having a length greater than that of the coupling block 52. Alternatively, the handle 53, shank 51 and coupling block 52 may have another length. For example, the shank 51 has a length greater than that of the handle 53 having a length greater than that of the coupling block 52. For example, the coupling block 52 has a length greater than that of the handle 53 having a length greater than that of the shank 51.

Referring to FIG. 12, a coupling notch 531 in a rod 533 of the handle 53 is disposed at an end of the rod 533, wherein the coupling notch 531 is between two opposing flat inside walls 5311 disposed at the end of the rod 533, and a screw hole 5312 laterally extending through the two opposing flat inside walls 5311. The coupling block 52 has a coupling end portion 521 at a first distal end thereof inserted into the coupling notch 531 in the rod 533 and a pivot hole 5211 laterally extends through the coupling end portion 521 of the coupling block 52 at the first distal end thereof. A pivot screw 5313 is threaded into the screw hole 5312 and inserted through the pivot hole 5211 at the first distal end of the coupling block 52 to pivotally connect the handle 53 and the coupling block 52 together, wherein the coupling end portion 521 at the first distal end of the coupling block 52 has two opposing cut planes 5212 in close contact with the respective flat inside walls 5311 of the rod 533. The handle 53 includes a holding sleeve 532 sleeved around the rod 533. The holding sleeve 532 is provided with two radially-extending threaded holes 5322 screwed with two respective screws 5321. Two annular grooves 5314 are cut around the rod 533 and covered by the holding sleeve 532. When the screws 5321 are screwed with the threaded holes 5322, the screws 5321 are inserted into the annular grooves 5314 respectively for preventing the holding sleeve 532 from axially moving but the holding sleeve 532 may rotate relatively to the rod 533. The holding sleeve 532 may have a hexagonal periphery, circular periphery, square periphery or polygonal periphery. The holding sleeve 532 may have a rough surface to lead a user to tightly hold the hand tool.

Referring to FIGS. 12 and 13, a coupling notch 511 in a rod 513 of the shank 51 is disposed at an end of the rod 513, wherein the coupling notch 511 is between two opposing flat inside walls 5111 disposed at the end of the rod 513, and a screw hole 5112 laterally extending through the two opposing flat inside walls 5111. The coupling block 52 has another coupling end portion 521 at a second distal end thereof inserted into the coupling notch 511 in the rod 513 and a pivot hole 5211 laterally extends through the coupling end portion 521 of the coupling block 52 at the second distal end thereof. A pivot screw 5113 is threaded into the screw hole 5112 and inserted through the pivot hole 5211 at the second distal end of the coupling block 52 to pivotally connect the shank 51 and the coupling block 52 together, wherein the coupling end portion 521 at the second distal end of the coupling block 52 has two opposing cut planes 5212 in close contact with the respective flat inside walls 5111 of the rod 513. The shank 51 includes a tool head 6 coupled to the rod 513 via a screw rod 5121. The tool head 6 includes a transmission shaft composed of a first shaft body 67, a second shaft body 631 having a step 635 at an upper end thereof engaged with a step 671 of the first shaft body 67 at a lower end thereof, a cylindrical body 632 having an upper flat surface 6321 substantially vertical to an axis of the receiving hole 613, wherein the second shaft body 631 integrally and upwardly protrudes from the upper flat surface 6321, and multiple tooth blocks 634 integrally and downwardly protruding from a lower flat surface 6322 of the cylindrical body 632 substantially vertical to the axis of the receiving hole 613. The tooth blocks 634 are arranged in a ring. The second shaft body 631, cylindrical body 632 and tooth blocks 634 are integral with one another. An insertion hole 512 in the rod 513 has an opening at the other end of the rod 513 and receives the first shaft body 67 of the transmission shaft. A mounting screw hole 5122 radially extends through the rod 513 and transversely extends across the insertion hole 512. The screw rod 5121 is threaded into the mounting screw hole 5122 and inserted through a coupling hole 672 radially extending through the first shaft body 67 of the transmission shaft at an upper end thereof so as to couple the rod 513 to the transmission shaft.

Figure 14:
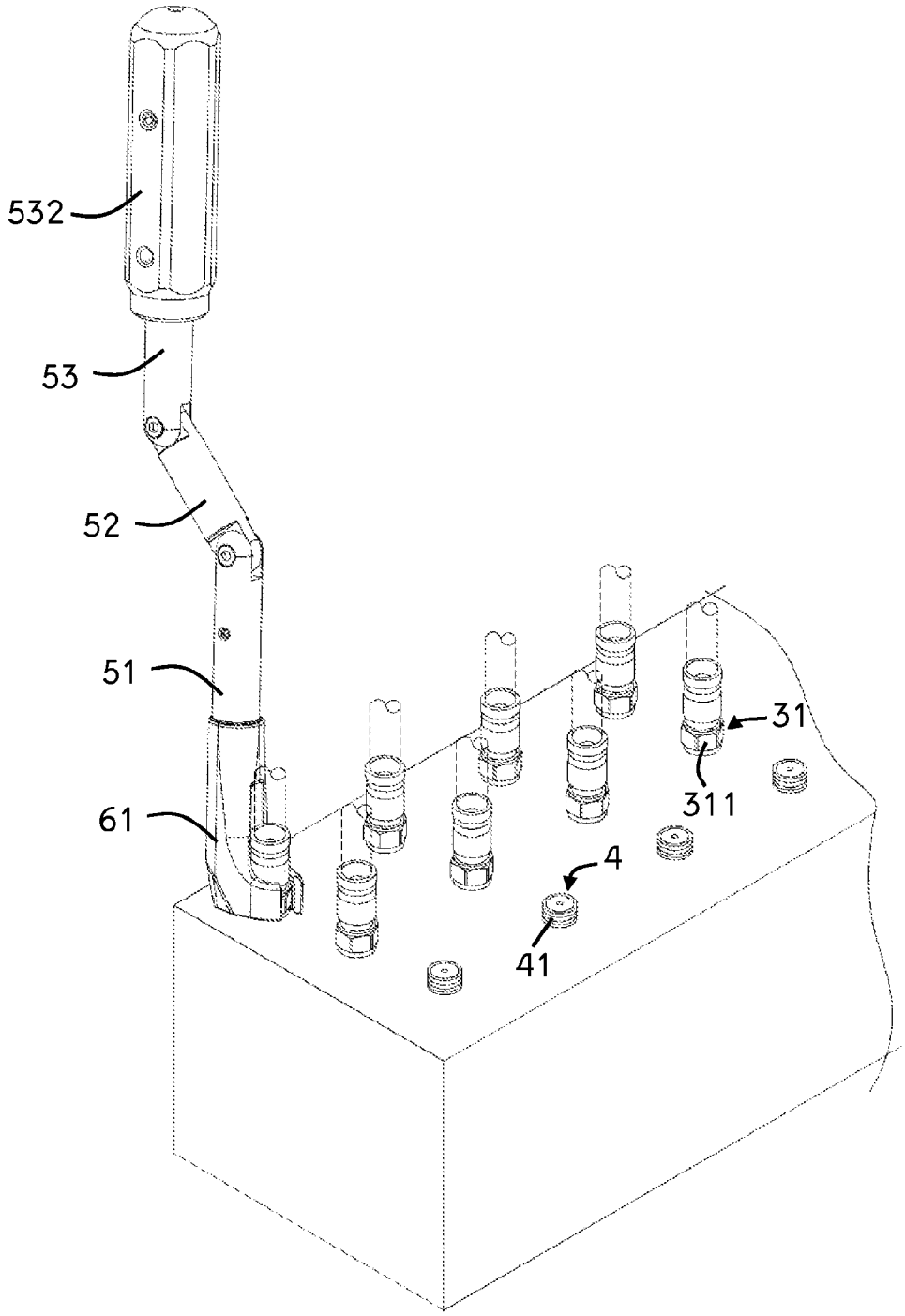
FIG. 14 is a perspective view showing the hand tool operating with a coaxial cable connector in accordance with the third embodiment of the present invention.

Referring to FIGS. 12 and 13A, the tool head 6 may further include a socket or sleeve 61 provided with a receiving hole 613 accommodating the tooth blocks 634 and cylindrical body 632 of the transmission shaft. A non-enclosed ring or C-shaped ring surrounds a socket hole 611 extending axially beside the receiving hole 613 is integral with the sleeve 61, wherein the non-enclosed ring has at least one pair of opposing bearing portions 6111 attachable to a locknut 31 of a coaxial cable 3 for fastening or loosening the locknut 31, as shown in FIG. 14. A side opening 612 between two ends of the non-enclosed ring laterally communicates with the socket hole 611 and has a function of having the locknut 31 to be easily inserted into the socket hole 611 therethrough such that the socket hole 611 may easily fit with the locknut 31. A cross-shaped positioning hole 6132 is at a bottom of the receiving hole 613. Alternatively, the positioning hole 6132 may have an X shape, square shape, round shape, ring shape, triangle shape or polygon shape.

Referring to FIGS. 12 and 13A-13D, the tool head 6 may further include a blocking member 62 non-integral with the sleeve 61 and detachable from the sleeve 61. The blocking member 62 include a cylindrical body 623, multiple stop blocks 622 integrally and upwardly protruding from an upper flat surface 6231 of the cylindrical body 623 substantially vertical to the axis of the receiving hole 613 and a cross-shaped positioning block 621 integrally and downwardly protruding from a lower flat surface 6232 of the cylindrical body 623 substantially vertical to the axis of the receiving hole 613. The stop blocks 622 are arranged in a ring. The cylindrical body 623, stop blocks 622 and positioning block 621 are integral with one another. The blocking member 62 is arranged at a bottom of the receiving hole 613 in the sleeve 61 with the cross-shaped positioning block 621 being engaged with the cross-shaped positioning hole 6132 and thereby the blocking member 62 may be prevented from rotating relatively to the receiving hole 613. Alternatively, the positioning hole 6132 may have an X shape, square shape, round shape, ring shape, triangle shape or polygon shape; the positioning block 621 has the corresponding shape.

Referring to FIGS. 12 and 13A-13D, each of the stop blocks 622 upwardly protrudes from the upper flat surface 6231 of the cylindrical body 623 substantially vertical to an axis of the receiving hole 613. Each stop block 622 has an opposing push face 6221 and vertical stop face 6222 substantially parallel with the axis of the receiving hole 613. An angle between the push face 6221 and the vertical stop face 6222 may range from 25 to 60 degrees or range from 30 to 45 degrees, for example. A slope angle between the vertical stop face 6222 and the upper flat surface 6231 is greater than that between the push face 6221 and the upper flat surface 6231. The slope angle between the vertical stop face 6222 and the upper flat surface 6231 may be a substantially right angle or range from 75 to 90 degrees, for example. The slope angle between the push face 6221 and the upper flat surface 6231 may range from 15 to 75 degrees. Alternatively, the push face 6221 may be a curved surface with a gradually small slope from bottom to top with respect to the upper flat surface 6231.

Referring to FIGS. 12 and 13A, each tooth block 634 has an opposing slope face 6341 and vertical face 6342 substantially parallel with the axis of the receiving hole 613. An angle between the slope face 6341 and the vertical face 6342 may range from 25 to 60 degrees or range from 30 to 45 degrees, for example. A slope angle between the vertical face 6342 and the lower flat surface 6322 is greater than that between the slope face 6341 and the lower flat surface 6322. The slope angle between the vertical face 6342 and the lower flat surface 6322 may be a substantially right angle or range from 75 to 90 degrees, for example. The slope angle between the slope face 6341 and the lower flat surface 6322 may range from 15 to 75 degrees. Alternatively, the slope face 6341 may be a curved surface with a gradually small slope from top to bottom with respect to the lower flat surface 6322.

Referring to FIGS. 12 and 13A, the tool head 6 further comprises a compression spring 64, such as coil spring, sleeved onto and around the second shaft body 631, wherein the compression spring 64 has a lower end stopped at the upper flat surface 6321 of the cylindrical body 632. The hand tool further comprises multiple sequentially-arranged axle bushings 65 each having a threaded portion 652 at a circumference thereof engaged with a threaded portion 6133 of an inner wall of the sleeve 61 and at an upper opening 6131 of the receiving hole 613 in the sleeve 61. The axle bushings 65 are sleeved onto and around the second shaft body 631 of the transmission shaft, wherein a through hole 651 in each of the axle bushings 65 may receive the second shaft body 631, that is, an inner hole axially through each of the axle bushings 65 receives the second shaft body 631 of the transmission shaft and has a diameter smaller than that of the receiving hole 613, wherein the inner holes axially through the axle bushings 65 have substantially the same diameter. The bottom one of the axle bushings 65 is stopped at an upper end of the compression spring 64 against the cylindrical body 632 of the transmission shaft. The axle bushings 65 are not a requisite member. Alternatively, the compression spring 23 may be mounted around the second shaft body 631 of the transmission shaft and stopped between the cylindrical body 632 of the transmission shaft and the rod 513 of the shank 51. Alternatively, the number of the axle bushings 65 is adjustable. For example, the number of the axle bushings may be one; the axle bushings 65 may be combined into an axle bushing having a threaded portion at a circumference thereof engaged with the threaded portion of the inner wall of the sleeve 61.

Referring to FIG. 13A, during the assembly of the tool head 6, the blocking member 62 is first mounted at the bottom of the receiving hole 613 with the cross-shaped positioning block 621 of the blocking member 62 being engaged with the cross-shaped positioning hole 6132 at the bottom of the receiving hole 613. Next, the integral structure 63 composed of the second shaft body 631, cylindrical body 632 and tooth blocks 634 is inserted into the receiving hole 613 with the lower flat surface of the cylindrical body 632 facing the upper flat surface of the cylindrical body 623 and the tooth blocks 634 contacting the stop blocks 622 of the blocking member 62. Next, the compressing spring 64 is sleeved onto and around the second shaft body 631 and arranged over the cylindrical body 632. Next, the two axle bushings 65 are sequentially sleeved onto and around the second shaft body 631 and arranged over the compressing spring 64 and at the upper opening 6131 of the receiving hole 613, and the threaded portions 652 of the two axle bushings 65 are screwed with the threaded portion 6133 of the inner wall of the sleeve 61. Thereby, the compressing spring 64 is arranged between the cylindrical body 632 and the bottom one of the axle bushings 65. Alternatively, only one axle bushing may be used to have a threaded portion screwed with the threaded portion 6133 of the inner wall of the sleeve 61.

Referring to FIG. 13A, at this time, the step 635 of the second shaft body 631 is outside the receiving hole 613. The step 635 has two non-coplanar flat surfaces 6351 and 6352 that are substantially parallel with each other and with an axis of the second shaft body 631 coaxial with the axis of the receiving hole 613, and a radial surface 6353 connecting the two non-coplanar flat surfaces 6351 and 6352, wherein the radial surface of the step 635 is substantially vertical to the axis of the second shaft body 631 or the axis of the receiving hole 613. For more elaboration, the second shaft body 631 contains a top portion provided with the flat surface 6351, a middle portion provided with the flat surface 6352 and a bottom portion having a width, i.e. diameter, greater than a width between the flat surface 6351 of the top portion and a periphery of the top portion and a width between the flat surface 6352 and a periphery of the middle portion, wherein the width between the flat surface 6351 of the top portion and the periphery of the top portion is greater than the width between the flat surface 6352 of the middle portion and the periphery of the middle portion. The flat surface 6352 is recessed from the flat surface 6351. The middle portion is between the top and bottom portions. The top portion is provided with the radial surface 6353 connecting the two non-coplanar flat surfaces 6351 and 6352.

Referring to FIG. 13A, the step 671 has two non-coplanar flat surfaces 6711 and 6712 that are substantially parallel with each other and with an axis of the first shaft body 67 coaxial with the axis of the second shaft body 631 and the axis of the receiving hole 613, and a radial surface 6713 connecting the two non-coplanar flat surfaces 6711 and 6712, wherein the radial surface 6713 of the step 671 is substantially vertical to the axis of the first shaft body 67. For more elaboration, the first shaft body 67 includes a bottom portion provided with the flat surface 6711, a middle portion provided with the flat surface 6712 and a top portion having a width, i.e. diameter, greater than a width between the flat surface 6711 of the bottom portion and a periphery of the bottom portion and a width between the flat surface 6712 and a periphery of the middle portion, wherein the width between the flat surface 6711 and the periphery of the bottom portion is greater than the width between the flat surface 6712 and the periphery of the middle portion. The flat surface 6712 is recessed from the flat surface 6711. The middle portion is between said top and bottom portions. The top portion is provided with the radial surface 6713 connecting the two non-coplanar flat surfaces 6711 and 6712.

Referring to FIG. 13A, after the two axle bushings 65 are screwed with the inner wall of the sleeve 61, the step 671 of first shaft body 67 is engaged with the step 635 of the second shaft body 631 with the radial surface 6353 of the step 635 contacting the radial surface 6713 of the step 671, the flat surface 6352 of the step 635 contacting the flat surface 6711 of the step 671, and the flat surface 6351 of the step 635 contacting the flat surface 6712 of the step 671. Next, the rod 513 is moved to lead the insertion hole 512 in the rod 513 to receive the first shaft body 67 and a top portion of the second shaft body 631 and the steps 671 and 635 of the first and second shaft bodies 67 and 631. Next, the screw rod 5121 is threaded into the mounting screw hole 5122 in the rod 513 and inserted through the coupling hole 672 in the first shaft body 67. Alternatively, the first and second shaft bodies 67 and 631 may be integral into a body. Accordingly, the second shaft body 631 may rotate along with the first shaft body 67 when the first shaft body 67 is driven by the handle 53 to rotate.

Alternatively, after the two axle bushings 65 are screwed with the inner wall of the sleeve 61 and before the first shaft body 67 is engaged with the second shaft body 631, a plastic bushing 66 may be further provided to be sleeved onto and around the second shaft body 631 and arranged over the top one of the axle bushings 65.

FIG. 14 is a perspective view showing the hand tool operating with a coaxial cable connector in accordance with the third embodiment of the present invention. Referring to FIG. 14, the hand tool of the invention is practical for use in a cable TV system for fastening a coaxial cable 3 to one connection screw rod 41 of an electrical connector 4 at an electronic device 5, such as signal distributor or adapter. During installation, a center conductor (not shown) of a coaxial cable 3 is inserted into a center contact hole in a connection screw rod 41 of an electrical connector 4, the locknut 31 of the coaxial cable 3 is threaded onto the connection screw rod 41 of the electrical connector 4 by a labor, and then the socket hole 611 beside the sleeve 61 of the hand tool is attached to the locknut 31 so as to tightly fasten the locknut 31 to the connection screw rod 41 of the electrical connector 4. By means of the side opening 612, the locknut 31 can be laterally inserted into the socket hole 611 and a hexagonal periphery 311 of the locknut 31 may abut against the opposing bearing portions 6111 of the non-enclosed ring. At this time, the user can hold the handle 53 at about 90-degree angle relative to the shank 51 and then operate the handle 53 to rotate the first and second shaft bodies 67 and 631 and tool head 6 in a clockwise direction, thereby fastening up the locknut 31. Subject to the coupling arrangement of the coupling block 52 between the shank 51 and the handle 53, the handle 53 can be operated to any desired angle relative to the sleeve 61 to fit different installation conditions, facilitating application in a narrow space. The locknut 31 may have a hexagonal periphery, pentagonal periphery, circular periphery, square periphery or polygon periphery and thereby the socket hole 611 may have a corresponding shape for fitting with the alternative locknut 31. The locknut 31 may have a rough surface.

Figure 15:
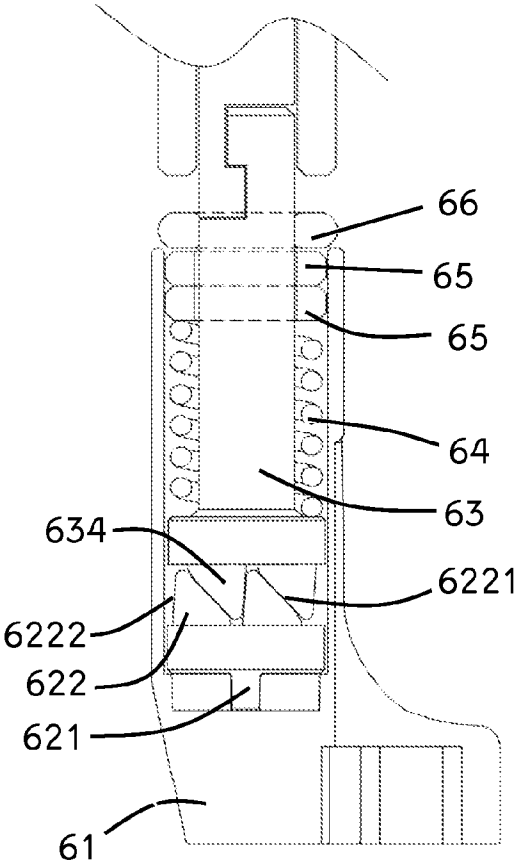
FIG. 15 is a schematic view showing the tooth block of the transmission shaft operates with the stop block of the sleeve in accordance with the first embodiment of the present invention when the hand tool is used to loose a nut of a coaxial cable connector off the electronic device.

Referring to FIGS. 13A, 14 and 15, during application of the hand tool, the compression spring 64 imparts a pressure to the cylindrical body 632 in a direction away from the axle bushings 65 (or the rod 513), forcing the tooth blocks 634 into positive engagement with the stop blocks 622 of the blocking member 62, and therefore the sleeve 61 can be positively driven by the handle 53 to rotate the locknut 31 of the coaxial cable 3 relatively to the connection screw rod 41 of the electrical connector 4 of the electronic device 5 to fasten tight or loosen the locknut 31.

Figure 16:
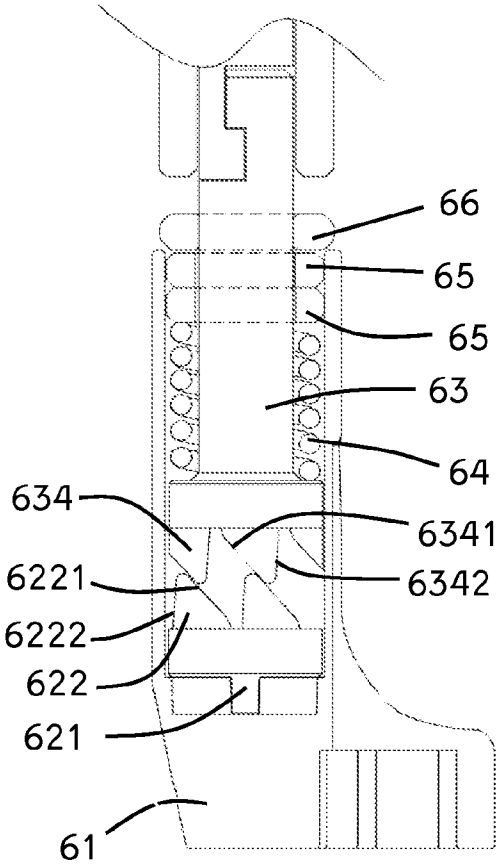
FIG. 16 is a schematic view showing a tooth block of a transmission shaft operates with a stop block of a sleeve in accordance with the third embodiment of the present invention when the hand tool is used to lock a nut of a coaxial cable connector to an electronic device with reaching a predetermined torque value.

Referring to FIGS. 13A, 14 and 16, when the socket hole 611 reaches a predetermined torque value during rotation of the locknut 31 relatively to the connection screw rod 41 of the electrical connector 4 of the electronic device 5, the slope faces 6341 of the tooth blocks 634 abut against the push faces 6221 of the respective stop blocks 622 of the blocking member 62. When continuously rotating the first and second shaft bodies 67 and 631 by applying force to the handle 53 at this time, the slope faces 6341 of the tooth blocks 634 may move along the push faces 6221 of the stop blocks 622 of the blocking member 62 such that the first and second shaft bodies 67 and 631 may be driven to upwardly move along the axis of the receiving hole 613 far away from the cylindrical body 623 of the blocking member 62 and to press the compression spring 64 without the rotation of the locknut 31 relatively to the connection screw rod 41 of the electrical connector 4 of the electronic device 5. Thereby, the hand tool may run idle. Accordingly, the hexagonal periphery 311 of the locknut 31 and the socket hole 611 may be avoided from being damaged due to extremely large force applied thereto. Durability of the hand tool may be enhanced. When still continuously rotating the first and second shaft bodies 67 and 631 by applying force to the handle 53 at this time, each of the tooth blocks 634 rotates across over the corresponding stop block 622 of the blocking member 62 and is driven, by the pressure of the compression spring 64 against the cylindrical body 632, to promptly downwardly move along the axis of the receiving hole 613 toward the cylindrical body 623 of the blocking member 62 and contact another one of the stop blocks 622, creating a knocking sound. Accordingly, the hand tool may have improved life span.

Referring to FIGS. 13A, 14 and 15, when the user wishes to loosen the locknut 31 of the coaxial cable 3 from the connection screw rod 41 of the electrical connector 4 of the electronic device 5, the opposing bearing portions 6111 of the non-enclosed ring is attached to the hexagonal periphery 311 of the locknut 31, and then the handle 53 may be operated to rotate the tool head 6 in a counterclockwise direction such that the vertical faces 6342 of the tooth blocks 634 abut against the respective vertical stop faces 6222 of the stop blocks 622 of the blocking member 62. Thereby, the sleeve 61 and the first and second shaft bodies 67 and 631 may be driven to simultaneously rotate so as to lead the locknut 31 to rotate relatively to the connection screw rod 41 of the electrical connector 4. When the locknut 31 is being loosened, the opposing bearing portions 6111 of the non-enclosed ring abut against the hexagonal periphery 311 of the locknut 31, enabling the locknut 31 to be rotated by the sleeve 61 positively without causing damage. Further, the sleeve 61, first and second shaft bodies 67 and 631 and compression spring 64 are detachable, facilitating replacement of a different design of sleeve or a compression spring having a different coefficient of elasticity to fit different application requirements and predetermined torque values based on various types or sizes of locknuts.

Thus, referring to FIGS. 13A, 14 and 15, when the user is going to loosen the locknut 31 of the coaxial cable 3, the user simply needs to rotate the handle 53 in the reversed direction. Subject to abutment between the vertical faces 6342 of the tooth blocks 634 and the vertical stop faces 6222 of the stop blocks 622, abutment between the step 671 of the first shaft body 67 and the step 635 of the second shaft body 631, abutment between the cross-shaped positioning block 621 of the blocking member 62 and the cross-shaped positioning hole 6132 at the bottom of the receiving hole 613, and abutment between the opposing bearing portions 6111 of the non-enclosed ring and the hexagonal periphery 311 of the locknut 31 of the coaxial cable 3, the sleeve 61 is driven by the handle 53 to rotate the locknut 31 of the coaxial cable 3 positively. The hexagonal periphery 311 of the locknut 31 and the socket hole 611 may be avoided from being damaged due to extremely large force applied thereto. Even if the locknut 31 has been slightly worn, the sleeve 61 can still be used to positively rotate the locknut 31.

As mentioned above, each of the tooth blocks 634 is between corresponding two of the stop blocks 622; the each of the tooth blocks 634 has a slope face 6341 configured to contact a push face 6221 of one of the corresponding two of the stop blocks 622 and a vertical face 6342 configured to contact a vertical stop face 6222 of the other one of the corresponding two of the stop blocks 622. In the other words, each of the stop blocks 622 is between corresponding two of the tooth blocks 634; the each of the stop blocks 622 has a push face 6221 configured to contact a slope face 6341 of one of the corresponding two of the tooth blocks 634 and a vertical stop face 6222 configured to contact a vertical face 6342 of the other one of the corresponding two of the tooth blocks 634. Each of the tooth blocks 634 has a gradually small cross-sectional area from top to bottom in the axis of the receiving hole 613. Each of the stop blocks 622 has a gradually small cross-sectional area from bottom to top in the axis of the receiving hole 613. The stop blocks 622 are non-integral with the sleeve 61, the tooth blocks 634 and the cylindrical body 632. The stop blocks 622 are at a bottom of the receiving hole 613.

Fourth Embodiment

Figure 17B:
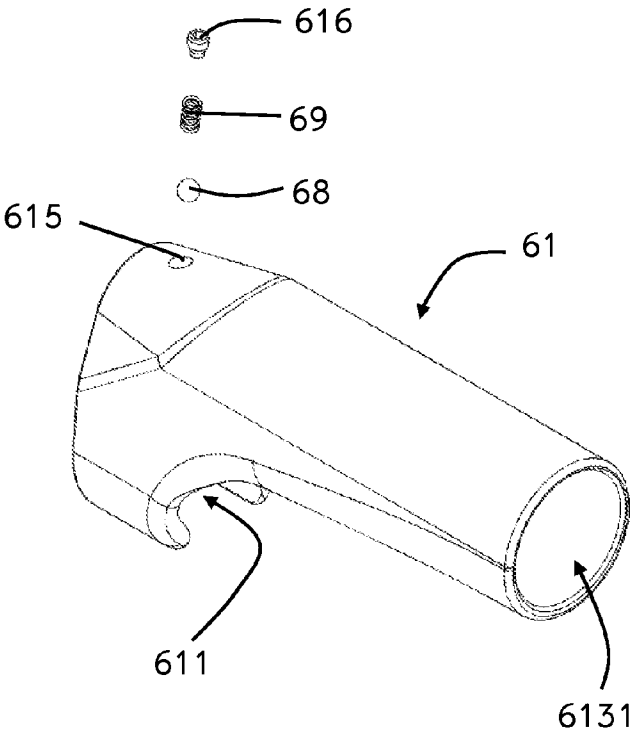
FIG. 17B is a perspective view showing the sleeve in accordance with the fourth embodiment of the present invention.
Figure 17A:
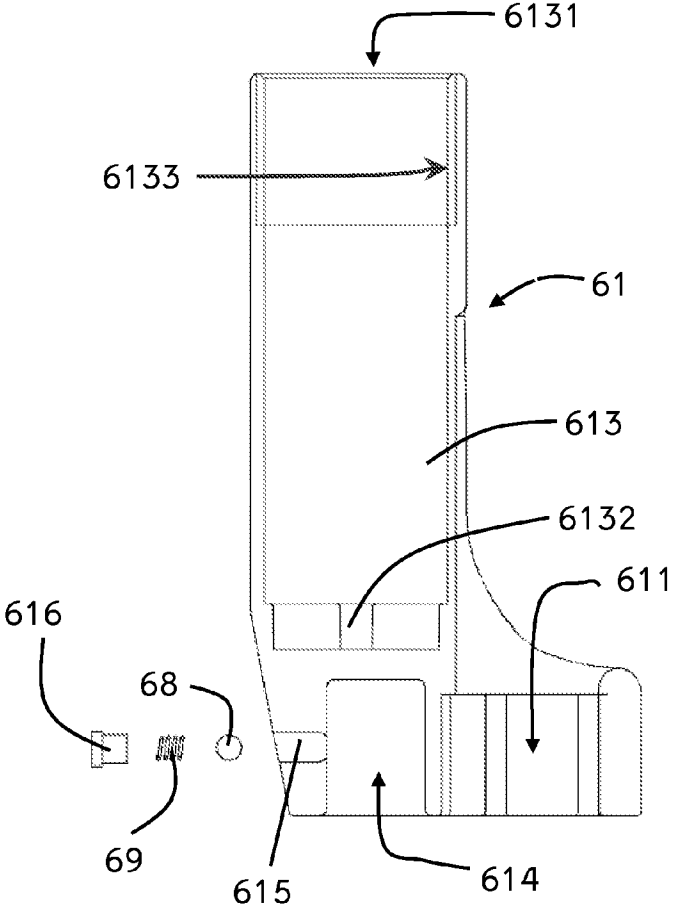
FIG. 17A is a schematically cross-sectional view showing a sleeve in accordance with a fourth embodiment of the present invention.
Figure 18:
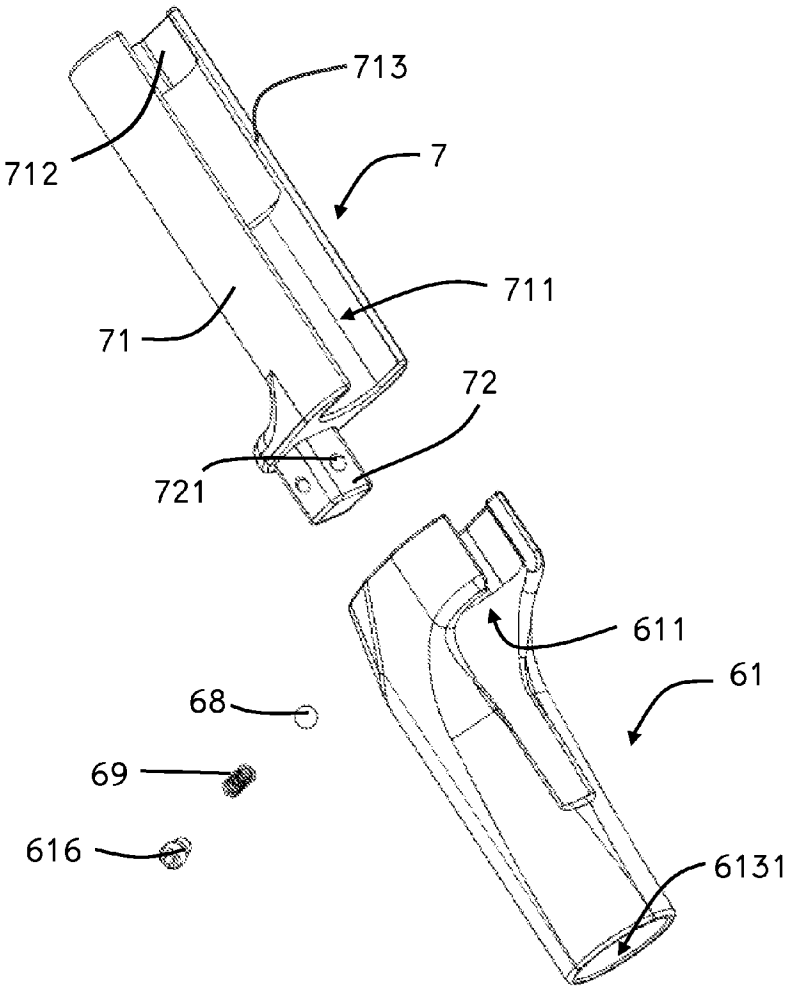
FIG. 18 is a perspective view showing the assembly of the sleeve and a locknut receiving member for a first fashion in accordance with the fourth embodiment of the present invention.
Figure 19:
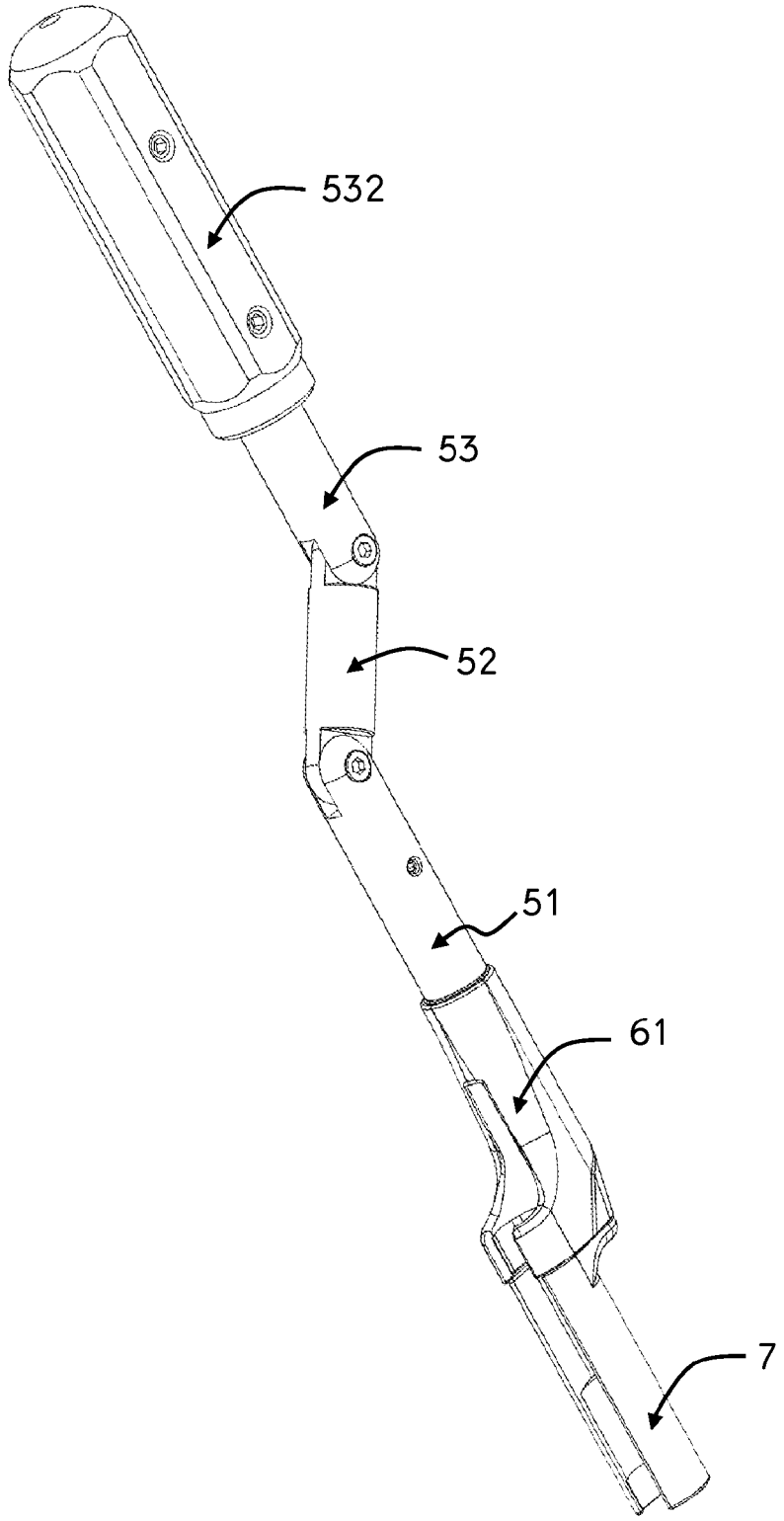
FIG. 19 is a perspective view showing the hand tool assembled with the locknut receiving member for the first fashion in accordance with the fourth embodiment of the present invention.

FIG. 17A is a schematically cross-sectional view showing a sleeve in accordance with a fourth embodiment of the present invention. FIG. 17B is a perspective view showing the sleeve in accordance with the fourth embodiment of the present invention. In accordance with the fourth embodiment, the sleeve 61 as illustrated in the third embodiment may be further provided with a square-shaped coupling hole 614 therein configured to be detachably coupled with a locknut receiving member 7 as shown in FIGS. 18 and 19. Alternatively, the coupling hole 614 may have a hexagonal perimeter, triangular perimeter, polygonal perimeter. A screw hole 615 laterally passes through a sidewall of the sleeve 61 and communicates with the coupling hole 614. The screw hole 615 has a gradually small diameter at a first distal end thereof communicating with the coupling hole 614 for stopping a metal ball 68. The smallest diameter of the screw hole 615 at the first distal end thereof communicating with the coupling hole 614 is smaller than the diameter of the metal ball 68. The metal ball 68 may have a first portion protruding from an inner surface of the sleeve 61 at a periphery of the coupling hole 614 and a second portion blocked in the screw hole 615. After the metal ball 68 is inserted into the screw hole 615 from the second distal end thereof, a coil spring 69 is inserted into the screw hole 615 from the second distal end thereof, and then a screw 616 is screwed with a threaded portion of the screw hole 615 at the second distal end thereof. The screw 616 may press the coil spring 69 against the metal ball 68 such that the first portion of the metal ball 68 is pressed to protrude from the inner surface of the sleeve 61 at the periphery of the coupling hole 614.

Referring to FIGS. 18 and 19, the locknut receiving member 7 includes a longitudinal non-enclosed ring or C-shaped ring 71 surrounding a socket hole 711 extending axially, wherein the longitudinal non-enclosed ring 71 has at least one pair of opposing bearing portions 712 attachable to the locknut 31 of the coaxial cable 3 for fastening or loosening the locknut 31, as shown in FIG. 5 or 14. A longitudinal side opening 713 between two ends of the non-enclosed ring 71 laterally communicates with the socket hole 711. By means of the longitudinal side opening 713, the locknut 31 can be laterally inserted into the socket hole 711 and the hexagonal periphery 311 of the locknut 31 may abut against the opposing bearing portions 712 of longitudinal non-enclosed ring 71. Thereby, the handle 53 may be operated relatively far away from the locknut 31. The locknut receiving member 7 further includes a coupling portion 72 having a shape corresponding to the shape of the coupling hole 614. In this embodiment, the coupling portion 72 has a square shape. Alternatively, the coupling portion 72 may have a hexagonal perimeter, triangular perimeter, polygonal perimeter. A coupling notch 721 at a surface of the coupling portion 72 is configured to receive the protrusion portion of the metal ball 68 as seen in FIGS. 17A and 17B. During the assembly of the sleeve 61 and the locknut receiving member 7, the coupling portion 72 is inserted into the coupling hole 614 with the socket hole 711 aligning with the socket hole 611. When the coupling portion 72 is being inserted into the coupling hole 614, the protrusion portion of the metal ball 68 is pressed by the coupling portion 72 back to the screw hole 615 until the coupling notch 721 aligns with and receives the protrusion portion of the metal ball 68. Thereby the locknut receiving member 7 may be securely coupled with the sleeve 61.

Figure 20:
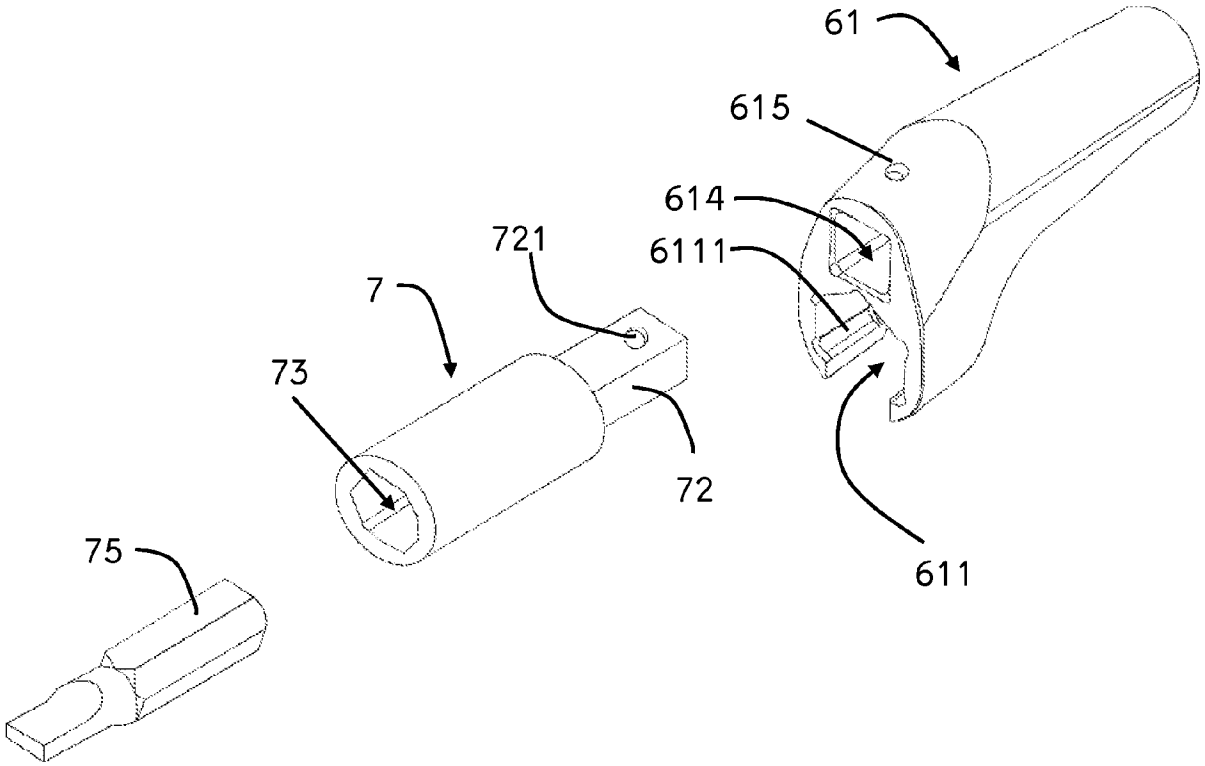
FIG. 20 is a perspective view showing the assembly of the sleeve and a screwdriver for a second fashion in accordance with the fourth embodiment of the present invention.

Referring to FIG. 20, a screwdriver receiving member 7 may be alternatively provided for coupling various screwdrivers. The screwdriver receiving member 7 shown in FIG. 20 may include the same coupling portion 72 as that of the locknut receiving member 7 shown in FIG. 18 so as to couple with the coupling hole 614 in the sleeve 61 in the same way as illustrated in FIGS. 17A, 17B and 18. A screwdriver receiving hole 73 in the screwdriver receiving member 7 has a hexagonal periphery and is configured to receive a screwdriver 75. Alternatively, the screwdriver receiving hole 73 may have a square periphery, triangular periphery or polygonal periphery. The screwdriver 75 may be a flathead screwdriver, Phillips screwdriver, Torx screwdriver, hexagonal screwdriver, square screwdriver, three-wing screwdriver, wing-shaped Phillips screwdriver, snake-eye screwdriver, xzn screwdriver, polydrive screwdriver, one-way screwdriver, double-hexagon screwdriver, octagonal screwdriver or Bristol screwdriver.

The components, steps, features, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, benefits and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A tool comprising:

a main body comprising a sleeve provided with a first inner hole therein, a first block in said first inner hole, wherein said first block has a gradually small cross-sectional area from top to bottom in an axis of said first inner hole, a second block in said first inner hole, wherein said second block has a gradually small cross-sectional area from top to bottom in said axis of said first inner hole, and a third block in said first inner hole, wherein said third block has a gradually small cross-sectional area from bottom to top in said axis of said inner hole, wherein said third block is configured to move to a gap between said first and second blocks, wherein said third block has a first surface configured to contact said first block and a second surface configured to contact said second block, wherein said tool is configured to receive a locknut of a coaxial cable.

2. The tool of claim 1, wherein said main body further comprises a first cylindrical body joining said first and second blocks, wherein said first cylindrical body has a first flat surface substantially vertical to said axis of said first inner hole, wherein said first and second blocks downwardly protrude from said first flat surface, wherein said first block has a surface configured to contact said first surface of said third block and said second block has a surface configured to contact said second surface of said third block, wherein a first angle between said surface of said first block and said first flat surface is less than a second angle between said surface of said second block and said first flat surface.

3. The tool of claim 2, wherein said first angle ranges from 15 to 75 degrees.

4. The tool of claim 2, wherein said second angle ranges from 75 to 90 degrees.

5. The tool of claim 2, wherein said main body further comprises a second cylindrical body joining said third block, wherein said second cylindrical body has a second flat surface substantially vertical to said axis of said first inner hole, wherein said third block upwardly protrude from said second flat surface, wherein an angle between said first surface of said third block and said second flat surface is less than that between said second surface of said third block and said second flat surface.

6. The tool of claim 5, wherein said second cylindrical body and third block are non-integral with said sleeve.

7. The tool of claim 1, wherein said third block is integral with said sleeve.

8. The tool of claim 1, wherein said main body further comprises a rod provided with a second inner hole therein, wherein said second inner hole is substantially coaxial with said first inner hole, a first shaft body having a portion in said second inner hole, wherein said portion of said first shaft body joins said rod, and a second shaft body having a portion in said first inner hole and a step abutting against a step of said first shaft, wherein said steps of said first and second shaft bodies are in said second inner hole.

9. The tool of claim 1, wherein said main body further comprises a cylindrical body joining said first and second blocks, wherein said first and second blocks downwardly protrude from said cylindrical body, a shaft body joining said cylindrical body, wherein said shaft body upwardly protrudes from said cylindrical body, a first bushing sleeved around said shaft body and screwed in said first inner hole, and a spring sleeved around said shaft body and arranged between said cylindrical body and said first bushing.

10. The tool of claim 9, wherein said main body further comprises a second bushing sleeved around said shaft body and screwed in said first inner hole, wherein said second bushing contacts said first bushing between said second bushing and said spring.

11. The tool of claim 1, wherein said main body further comprises a pair of opposing bearing portions integral with said sleeve, wherein said pair of opposing bearing portions are configured to fit with a hexagonal periphery of said locknut.

12. The tool of claim 1 further comprising a pair of opposing bearing portions configured to be detachably coupled with said main body of said tool, wherein said pair of opposing bearing portions is configured to fit with a hexagonal periphery of said locknut.

13. A tool comprising:

a main body comprising a rod provided with a first inner hole therein, a first shaft body having an inner portion in said first inner hole, wherein said inner portion of said first shaft body joins said rod, and a second shaft body having a step abutting against a step of said first shaft, wherein said steps of said first and second shaft bodies are in said first inner hole, wherein said tool is configured to receive a locknut of a coaxial cable.

14. The tool of claim 13, wherein said main body further comprises a screw screwed into a second inner hole radially through said rod and inserted into a third inner hole radially through said first shaft body.

15. The tool of claim 13, wherein said first shaft body has a first flat surface substantially parallel with an axis of said first inner hole and a second flat surface substantially parallel with said axis of said first inner hole, wherein said second flat surface is recessed from said first flat surface, wherein said first shaft body has a first retaining surface connecting said first flat surface to said second flat surface, wherein said first and second flat surfaces and first retaining surface compose said step of said first shaft body, wherein said second shaft body has a third flat surface substantially parallel with said axis of said first inner hole and a fourth flat surface substantially parallel with said axis of said first inner hole, wherein said fourth flat surface is recessed from said third flat surface, wherein said second shaft body has a second retaining surface connecting said third flat surface to said fourth flat surface, wherein said third and fourth flat surfaces and second retaining surface compose said step of said second shaft body, wherein said first retaining surface contacts said second retaining surface.

16. The tool of claim 13, further comprising a pair of opposing bearing portions configured to be detachably coupled with said main body of said tool, wherein said pair of opposing bearing portions is configured to fit with a hexagonal periphery of said locknut.

17. A tool comprising:

a main body comprising a sleeve provided with a first inner hole therein, a cylindrical body in said first inner hole, a shaft body joining said cylindrical body, wherein said cylindrical body has a diameter greater than that of said shaft body, a first bushing sleeved around said shaft body and joining said sleeve, wherein a second inner hole axially through said first bushing receives said shaft body and has a diameter smaller than that of said first inner hole, and a spring sleeved around said shaft body and arranged between said cylindrical body and said first bushing, wherein said tool is configured to receive a locknut of a coaxial cable.

18. The tool of claim 17, wherein said main body further comprises a second bushing sleeved around said shaft body and joining said sleeve, wherein a third inner hole axially through said second bushing receives said shaft body and has a diameter smaller than that of said first inner hole and substantially the same as that of said second inner hole, wherein said second bushing contacts said first bushing between said second bushing and said spring.

19. The tool of claim 18, wherein said first and second bushings are screwed in said first inner hole.

20. The tool of claim 17, further comprising a pair of opposing bearing portions configured to be detachably coupled with said main body of said tool, wherein said pair of opposing bearing portions is configured to fit with a hexagonal periphery of said locknut.

* * * * *